US010545424B2

(12) United States Patent
Hasegawa et al.

(10) Patent No.: US 10,545,424 B2
(45) Date of Patent: Jan. 28, 2020

(54) LIQUID DEVELOPER AND METHOD OF PRODUCING LIQUID DEVELOPER

(71) Applicant: CANON KABUSHIKI KAISHA, Tokyo (JP)

(72) Inventors: Waka Hasegawa, Tokyo (JP); Ryo Natori, Tokyo (JP); Ayano Mashida, Kawasaki (JP); Junji Ito, Hiratsuka (JP); Yasuhiro Aichi, Tokyo (JP); Jun Shirakawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/140,615

(22) Filed: Sep. 25, 2018

(65) Prior Publication Data

US 2019/0094734 A1 Mar. 28, 2019

(30) Foreign Application Priority Data

Sep. 28, 2017 (JP) ..... 2017-188259
Feb. 8, 2018 (JP) ..... 2018-021287

(51) Int. Cl.

| | |
|---|---|
| ***G03G 9/00*** | (2006.01) |
| ***G03G 9/13*** | (2006.01) |
| ***G03G 9/125*** | (2006.01) |
| *G03G 9/12* | (2006.01) |
| *G03G 9/135* | (2006.01) |

(52) U.S. Cl.

CPC ..... *G03G 9/132* (2013.01); *G03G 9/125* (2013.01); *G03G 9/13* (2013.01); *G03G 9/122* (2013.01); *G03G 9/135* (2013.01)

(58) Field of Classification Search

CPC ..... G03G 9/13; G03G 9/135
USPC ..... 430/114, 115
See application file for complete search history.

(56) References Cited

U.S. PATENT DOCUMENTS

| | | | |
|---|---|---|---|
| 5,760,257 | A | 6/1998 | Tanaka et al. |
| 7,833,687 | B2 | 11/2010 | Kato et al. |
| 8,697,327 | B2 | 4/2014 | Shibata et al. |
| 8,815,484 | B2 | 8/2014 | Tanaka et al. |
| 9,057,970 | B2 | 6/2015 | Ida et al. |
| 9,229,345 | B2 | 1/2016 | Ikeda et al. |

(Continued)

FOREIGN PATENT DOCUMENTS

| | | |
|---|---|---|
| EP | 1898267 A1 | 3/2008 |
| EP | 1898268 A1 | 3/2008 |

(Continued)

OTHER PUBLICATIONS

U.S. Appl. No. 15/969,103, Yuzo Tokunaga, filed May 2, 2018.

(Continued)

*Primary Examiner* — Mark A Chapman
(74) *Attorney, Agent, or Firm* — Venable LLP

(57) ABSTRACT

A liquid developer comprising a carrier liquid, a toner particle insoluble in the carrier liquid, and a polymer having a primary amino group and soluble in the carrier liquid, wherein the toner particle comprises a polyester resin having an acidic group, an acid value of the polyester resin is at least 5 mg KOH/g, a pKa of the acidic group is not more than 3.4, and the polymer having a primary amino group has a primary amino group at a position other than the end of a main chain of the polymer, and method of producing thereof.

10 Claims, 1 Drawing Sheet

(56) References Cited

U.S. PATENT DOCUMENTS

| | | | |
|---|---|---|---|
| 9,348,247 | B2 | 5/2016 | Ida et al. |
| 9,556,290 | B2 | 1/2017 | Nishiura et al. |
| 9,715,187 | B2 | 7/2017 | Makumoto et al. |
| 9,740,118 | B2 | 8/2017 | Hasegawa et al. |
| 9,766,568 | B2 | 9/2017 | Ito et al. |
| 9,857,716 | B2 | 1/2018 | Natori et al. |
| 9,880,482 | B2 | 1/2018 | Hasegawa et al. |
| 9,891,546 | B2 | 2/2018 | Ito et al. |
| 9,891,547 | B2 | 2/2018 | Tanabe et al. |
| 9,897,936 | B2 | 2/2018 | Natori et al. |
| 9,971,268 | B2 | 5/2018 | Tanabe et al. |
| 2010/0062361 | A1 | 3/2010 | Iwase |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2016/0349656 | A1* | 12/2016 | Hasegawa ..... G03G 9/0806 |
| 2017/0102628 | A1 | 4/2017 | Kabashima et al. |
| 2018/0046105 | A1 | 2/2018 | Tanabe et al. |
| 2018/0046106 | A1 | 2/2018 | Shirakawa et al. |
| 2018/0059566 | A1 | 3/2018 | Tanabe et al. |
| 2018/0143546 | A1 | 5/2018 | Hasegawa et al. |

FOREIGN PATENT DOCUMENTS

| | | | |
|---|---|---|---|
| EP | 2192450 | A1 | 6/2010 |
| JP | 2003241439 | B2 | 8/2003 |
| JP | 3718915 | B2 | 11/2005 |
| JP | 5148621 | B2 | 2/2013 |
| JP | 5870654 | B2 | 3/2016 |
| WO | 2006126566 | A1 | 11/2006 |
| WO | 2007000974 | A1 | 1/2007 |
| WO | 2007000975 | A1 | 1/2007 |
| WO | 2007108485 | A1 | 9/2007 |

OTHER PUBLICATIONS

U.S. Appl. No. 15/988,116, Naohiko Tsuchida, filed May 24, 2018.
Yuji Harazaki, "Basics and Technology of Coatings" Publisher: Converting Technical Institute ISBN-10: 4906451381, ISBN-13: 978-4906451388, (Jan. 2010), p. 53.

* cited by examiner

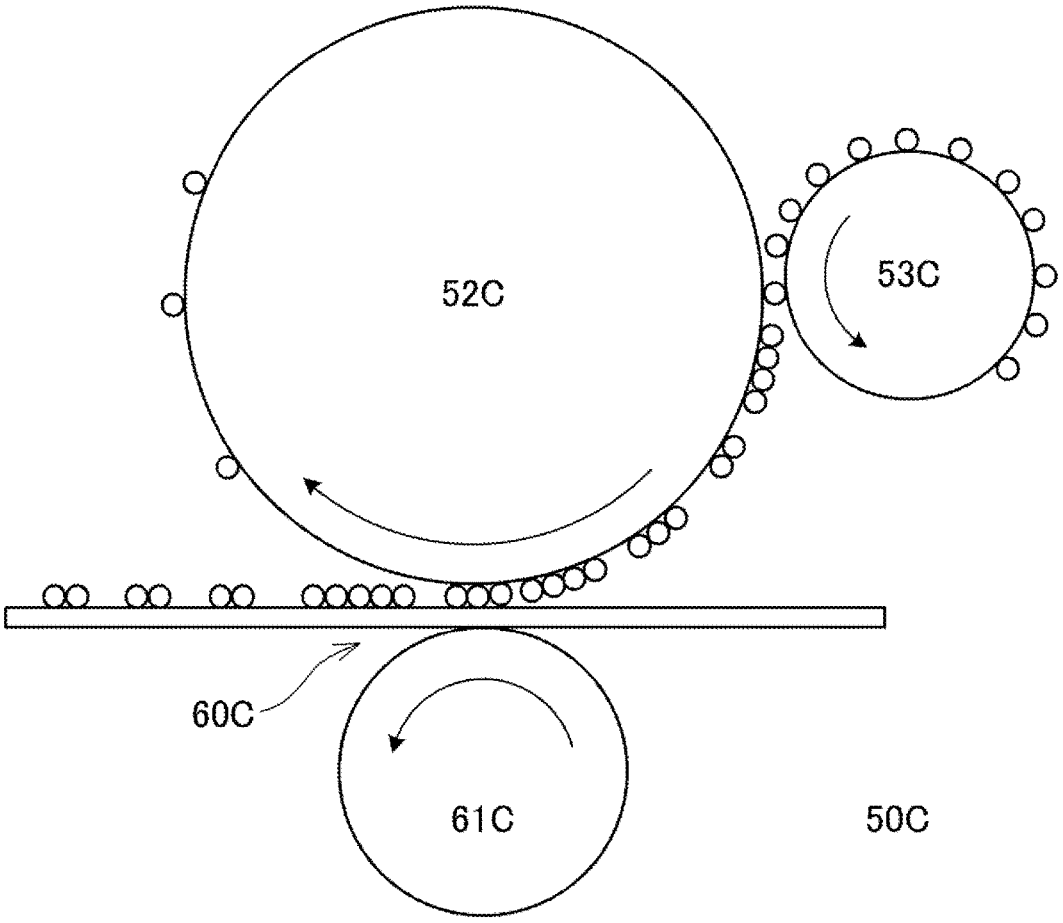
52C
53C
60C
61C
50C

LIQUID DEVELOPER AND METHOD OF PRODUCING LIQUID DEVELOPER

BACKGROUND OF THE INVENTION

Field of the Invention

The present invention relates to a liquid developer used for an image forming apparatus using an electrophotographic process, such as electrophotography, electrostatic recording, and electrostatic printing, and methods of producing the liquid developer.

Description of the Related Art

In recent years, a demand has increased for color image forming apparatuses using an electrophotographic process, such as copiers, facsimile machines, printer, and the like. Among them, high-speed digital printing devices with high image quality which use an electrophotographic technique and a liquid developer which has satisfactory reproducibility of fine linear images, good gradation reproducibility, excellent color reproducibility and excellent ability of forming images at a high speed have been actively developed. Accordingly, liquid developers having better characteristics need to be developed.

Japanese Patent No. 5870654 discloses a liquid developer composed of at least a toner particle including a binder resin (A), a colorant (B), and an inorganic oxide (C), and a carrier liquid (D) in order to improve cleaning property, developing performance, and hot offset resistance.

Further, Japanese Patent No. 5148621 discloses the following contents.

A method of producing a liquid developer capable of improving the dispersion stability of colored resin particles and improving a charging characteristic by using a particle dispersing agent, which is a reaction product of a polyamine compound and a self-condensate of a hydroxycarboxylic acid, and an acid group-containing resin.

SUMMARY OF THE INVENTION

In the liquid developer disclosed in Japanese Patent No. 5870654, the bonding force of the binder resin (A) and the inorganic oxide (C) is insufficient. As a result, satisfactory developing performance cannot be obtained.

Further, in the liquid developer disclosed in Japanese Patent No. 5148621, the bonding force of the acid group-containing resin and the particle dispersing agent is also insufficient. As a result, satisfactory developing performance cannot be obtained.

Thus, the present invention provides a liquid developer with high volume resistivity and excellent developing performance.

The present invention in its first aspect provides a liquid developer including a carrier liquid, a toner particle insoluble in the carrier liquid, and a polymer having a primary amino group and soluble in the carrier liquid, wherein the toner particle includes a polyester resin having an acidic group;

an acid value of the polyester resin is at least 5 mg KOH/g;

a pKa of the acidic group is not more than 3.4; and the polymer having a primary amino group has a primary amino group at a position other than the end of a main chain of the polymer.

The present invention in its second aspect provides a method of producing a liquid developer including a carrier liquid, a toner particle insoluble in the carrier liquid, and a polymer having a primary amino group and soluble in the carrier liquid, the method comprising:

(i) a step of preparing a resin-dispersed solution including a polyester resin having an acidic group, a polymer having a primary amino group, and a solvent dissolving the polyester resin;

(ii) a step of preparing a mixed liquid including the resin-dispersed solution and the carrier liquid; and (iii) a step of distilling off the solvent from the mixed liquid, wherein an acid value of the polyester resin having an acidic group is at least 5 mg KOH/g;

a pKa of the acidic group is not more than 3.4; and the polymer having a primary amino group has a primary amino group at a position other than the end of a main chain of the polymer.

The present invention in its third aspect provides a method of producing a liquid developer including a carrier liquid, a toner particle insoluble in the carrier liquid, and a polymer having a primary amino group and soluble in the carrier liquid, the method comprising:

(I) a step of preparing a resin-dispersed solution including a polyester resin having an acidic group, a polymer having a primary amino group, and a solvent dissolving the polyester resin;

(II) a step of preparing a first mixed liquid including the resin-dispersed solution and a solvent that does not dissolve the polyester resin, the solvent being other than the carrier liquid;

(III) a step of preparing a toner particle dispersion by distilling off the solvent dissolving the polyester resin from the first mixed liquid, and (IV) a step of preparing a second mixed liquid including the toner particle dispersion and the carrier liquid, wherein an acid value of the polyester resin having an acidic group is at least 5 mg KOH/g;

a pKa of the acidic group is not more than 3.4; and the polymer having a primary amino group has a primary amino group at a position other than the end of a main chain of the polymer.

According to the present invention, it is possible to provide a liquid developer with high volume resistivity and excellent developing performance.

Further features of the present invention will become apparent from the following description of exemplary embodiments with reference to the attached drawing.

BRIEF DESCRIPTION OF THE DRAWING

The FIGURE is a schematic diagram of a developing device.

DESCRIPTION OF THE EMBODIMENTS

The present invention in its first aspect provides a liquid developer including a carrier liquid, a toner particle insoluble in the carrier liquid, and a polymer having a primary amino group and soluble in the carrier liquid, wherein the toner particle includes a polyester resin having an acidic group;

an acid value of the polyester resin is at least 5 mg KOH/g;

a pKa of the acidic group is not more than 3.4; and the polymer having a primary amino group has a primary amino group at a position other than the end of a main chain of the polymer.

In the present invention "format least AA and not more than BB" and "from AA to BB" representing numerical ranges mean numerical ranges including the upper limit and lower limit, which are end points, unless specifically stated otherwise.

Further, a monomer unit means a reacted form of a monomer substance in a polymer or resin.

Various materials are described hereinbelow in detail.

The carrier liquid is not particularly limited as long as it is a liquid with high volume resistivity, electric insulating property, and low viscosity at a temperature close to room temperature.

The volume resistivity of the carrier liquid is preferably from $5\times10^{8}$ Ω·cm to $1\times10^{15}$ Ω·cm and more preferably from $1\times10^{9}$ Ω·cm to $1\times10^{13}$ Ω·cm.

The viscosity of the carrier liquid at 25° C. is preferably from 0.5 mPa·s to less than 100 mPa·s and more preferably from 0.5 mPa·s to less than 20 mPa·s.

An SP value of the carrier liquid is preferably from 7.0 to 9.0 and more preferably from 7.5 to 8.5.

The SP value, as referred to herein, is a solubility parameter. The SP value was introduced by Hildebrand and defined by a normalization theory. The solubility parameter is an indicator of solubility of two-component solutions and is represented by the square root of the cohesive energy density of a solvent (or solute).

The SP value was determined by calculations from the evaporation energy and molar volume of atoms and atomic groups according to Fedors described in Basics and Technology of Coatings (page 53, Harazaki Yuji, Converting Technical Institute).

The units of the SP value in the present invention are $(cal/cm^3)^{1/2}$, but it can be converted to the units of $(J/m^3)^{1/2}$ based on the relationship of 1 $(cal/cm^3)^{1/2}=2.046\times10^3$ $(J/m^3)^{1/2}$.

The carrier liquid can be exemplified by hydrocarbon solvents such as octane, isooctane, decane, isodecane, decaline, nonane, dodecane, isododecane, and the like; and paraffin solvents such as ISOPAR E, ISOPAR G, ISOPAR H, ISOPAR L, ISOPAR M, and ISOPAR V (Exxon Mobil Corp.), SHELLSOL A100, SHELLSOL A150 (Shell Chemicals Japan Co., Ltd.), MORESCO WHITE MT-30P (MORESCO Corporation), and the like.

In order to utilize a liquid developer as a curable liquid developer, a polymerizable liquid compound may be used for the carrier liquid. The polymerizable liquid compound is not particularly limited as long as physical properties of the carrier liquid are satisfied.

The polymerizable liquid compound may be a component polymerizable by a photopolymerization reaction.

The photopolymerization reaction may be a reaction induced by light of any type, but a reaction induced by UV radiation is preferred. Thus, the polymerizable liquid compound may be a UV-curable polymerizable liquid compound.

Polymerizable liquid compounds may be radical polymerizable, cation polymerizable, and radical and cation polymerizable, and the compound of any type can be suitable used.

Examples of suitable compounds include vinyl ether compounds, urethane compounds, styrene compounds, acryl compounds, and cyclic ether compounds such as epoxy compounds and oxetane compounds. The polymerizable liquid compounds may be used singly or in combination of two or more thereof.

The polymerizable liquid compound preferably includes a cation-polymerizable liquid monomer, and more preferably includes a vinyl ether compound.

When the vinyl ether compound is used, it is possible to obtain a curable liquid developer with high volume resistivity, low viscosity, and high sensitivity.

The vinyl ether compound, as referred to herein, indicates a compound having a vinyl ether structure (—CH═CH—O—C—).

The vinyl ether structure is preferably represented by R'—CH═CH—O—C—(R' is hydrogen or an alkyl group having 1 to 3 carbon atoms, preferably a hydrogen atom or a methyl group).

The vinyl ether compound is preferably a compound represented by the following formula (b).

$$(H_2C{=}CH{-}O{-})_nR \qquad (b)$$

Where, n indicates the number of vinyl ether structures in one molecule and is an integer of from 1 to 4. R is an n-valent hydrocarbon group.

It is preferable that n be an integer of from 1 to 3.

R is preferably a group selected from a linear or branched saturated or unsaturated aliphatic hydrocarbon group having from 1 to 20 carbon atoms, a saturated or unsaturated alicyclic hydrocarbon group having from 5 to 12 carbon atoms, and an aromatic hydrocarbon group having from 6 to 14 carbon atoms, and the alicyclic hydrocarbon group and the aromatic hydrocarbon group may have a saturated or unsaturated aliphatic hydrocarbon group having from 1 to 4 carbon atoms.

R is more preferably a linear or branched saturated aliphatic hydrocarbon group having from 4 to 18 carbon atoms.

Specific examples include dodecyl vinyl ether, dicyclopentadiene vinyl ether, cyclohexanedimethanol divinyl ether, tricyclodecane vinyl ether, dipropylene glycol divinyl ether, trimethylolpropane trivinyl ether, 2-ethyl-1,3-hexanediole divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, 1,2-decanediol divinyl ether and the like.

The toner particle is insoluble in the carrier liquid.

An indicator of "insolubility in the carrier liquid" is that the toner particle dissolves in 100 parts by mass of the carrier liquid at a temperature of 25° C. is not more than 1 part by mass.

From the viewpoint of obtaining a high-definition image it is preferable that the toner particle has a 50% particle diameter (D50), on a volume basis, of from 0.05 μm to 2.0 μm, more preferably from 0.05 μM to 1.2 μm, and even more preferably from 0.05 μm to 1.0 μm.

Where the 50% particle diameter (D50), on a volume basis, of the toner particle is within these ranges, sufficiently high resolution and image density of the toner image formed by the liquid developer can be obtained. At the same time, a sufficiently small film thickness of the toner image can be obtained even in a recording system in which the carrier liquid remains on the recording medium.

The concentration of the toner particle in the liquid developer is preferably about from 1% by mass to 50% by mass, and more preferably about from 2% by mass to 40% by mass.

The toner particle includes a polyester resin having an acidic group.

Further, the acid value of the polyester resin is at least 5 mg KOH/g.

Where the acid value of the polyester resin is less than 5 mg KOH/g, sufficient bonds cannot be formed between the polyester resin and the polymer having a primary amino group, separation of the polymer having a primary amino group into the carrier liquid cannot be suppressed, and the volume resistivity of the liquid developer decreases.

The acid value is preferably from 5 mg KOH/g to 100 mg KOH/g, and more preferably from 5 mg KOH/g to 50 mg KOH/g.

The acid value of the polyester resin can be controlled by the number of end groups and the number of acidic groups among the end groups.

The SP value of the polyester resin is preferably from 9.0 to 15.0, and more preferably from 9.5 to 13.0.

The polyester resin can be exemplified by a polycondensate of an alcohol monomer and a carboxylic acid monomer.

Examples of the alcohol monomer are presented hereinbelow.

Alkylene oxide adducts of bisphenol A such as polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis(4-hydroxyphenyl)propane; ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A, glycerin, sorbitol, 1,2,3,6-hexanetetrol, 1,4-sorbitan, pentaerythritol, dipentaerythritol, tripentaerythritol, 1,2,4-butanetriol, 1,2,5-pentanetriol, 2-methylpropanetriol, 2-methyl-1,2,4-butanetriol, trimethylolethane, trimethylolpropane, and 1,3,5-trihydroxymethylbenzene.

Examples of carboxylic acid monomers are presented hereinbelow.

Aromatic dicarboxylic acids such as phthalic acid, isophthalic acid, dihydroxyisophthalic acid, terephthalic acid, and dihydroxyterephthalic acid or anhydrides thereof; alkyldicarboxylic acids such as succinic acid, adipic acid, sebacic acid, and azelaic acid or anhydrides thereof; succinic acid substituted with an alkyl group having 6 to 18 carbon atoms or an alkenyl group having 6 to 18 carbon atoms or an anhydride thereof; and unsaturated dicarboxylic acids such as fumaric acid, maleic acid, and citraconic acid and anhydrides thereof.

In addition, the following monomers can be used.

Polyhydric alcohols such as an oxyalkylene ethers of novolac phenolic resin; and polyvalent carboxylic acids such as trimellitic acid, pyromellitic acid, and benzophenonetetracarboxylic acid and anhydrides thereof.

Among them, it is preferable that any one of the carboxylic acid monomer and alcohol monomer have an aromatic ring. With the aromatic ring, it is possible to reduce crystallinity of the polyester resin and improve solubility in the solvent.

The number average molecular weight (Mn) of the polyester resin is preferably from 2000 to 20,000, more preferably from 3000 to 15,000, and even more preferably from 4000 to 10,000.

The pKa of the acidic group of the polyester resin is not more than 3.4.

The pKa is preferably not more than 3.3 and more preferably not more than 3.2.

The lower limit of the pKa is not particularly limited, but is preferably at least 1.0, and more preferably at least 2.0.

The pKa of the acidic group of the polyester resin can be determined by neutral titration.

Where the pKa of the acidic group of the polyester resin is within the abovementioned ranges, the ion bond with the polymer having a primary amino group is strengthened and the amount of the polymer having a primary amino group which is separated into the carrier liquid can be greatly reduced.

The acidic group is preferably at least one selected from the group consisting of a carboxyl group, a sulfone group, and a phosphone group.

Among them, a carboxyl group is more preferred.

The polyester resin with the pKa of the acidic group within the abovementioned ranges can be synthesized by a well-known method.

For example, it is possible to synthesize a polyester resin having the desired composition and molecular weight so as to obtain an acid value of 0 mg KOH/g, and then condensate a carboxylic acid or a carboxylic anhydride with the pKa in the above-mentioned range on the molecular end.

The carboxylic acid and carboxylic anhydride are preferably trimellitic anhydride, pyromellitic anhydride, trimellitic acid, pyromellitic acid, 2,5-dihydroxyterephthalic acid, 4,6-dihydroxyisophthalic acid, and the like.

Among them, trimellitic acid and trimellitic anhydride are preferred.

Thus, it is preferable that the polyester resin include a monomer unit derived from trimellitic acid or trimellitic anhydride, and the acidic group be a carboxyl group derived from trimellitic acid or trimellitic anhydride.

The toner particle may include a resin other than the polyester resin as a resin component.

Examples of the resin include a vinyl resin, a polyurethane resin, an epoxy resin, a polyamide resin, a polyimide resin, a silicone resin, a phenolic resin, a melamine resin, a urea resin, an aniline resin, an ionomer resin, a polycarbonate resin, and the like.

These resins may be used in combination of two or more thereof.

The amount of the polyester resin with an acid value of at least 5 mg KOH/g in the resin component of the toner particle is preferably from 50% by mass to 90% by mass, and more preferably from 50% by mass to 80% by mass.

The toner particle may include a colorant.

The colorant is not particularly limited and examples thereof include well-known organic pigments and inorganic pigment.

Specific examples of the pigments include the following pigments of yellow color.

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; C. I. Vat Yellow 1, 3, 20.

Examples of pigments of red or magenta color are presented below.

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269; C. I. Pigment Violet 19; C. I. Vat Red 1, 2, 10, 13, 15, 23, 29, 35.

Examples of pigments of blue or cyan color are presented below.

C. I. Pigment Blue 2, 3, 15:2, 15:3, 15:4, 16, 17; C. I. Vat Blue 6; C. I. Acid Blue 45, and copper phthalocyanine pigment in which from 1 to 5 phthalimidomethyl groups in the phthalocyanine skeleton are substituted.

Examples of pigments of green color are presented below.

C. I. Pigment Green 7, 8, 36.

Examples of pigments of orange color are presented below.

C. I. Pigment Orange 66, 51.

Examples of pigments of black color are presented below.

Carbon black, titanium black, aniline black.

Examples of pigments of white color are presented below.

Basic lead carbonate, zinc oxide, titanium oxide, and strontium titanate.

A dispersion means corresponding to the method of producing the toner particle may be used for dispersing the pigment in the toner particle. Examples of apparatuses that can be used as the dispersion means include a ball mill, a sand mill, an attritor, a roll mill, a jet mill, a homogenizer, a paint shaker, a kneader, an agitator, a HENSCHEL MIXER, a colloid mill, an ultrasonic homogenizer, a pearl mill, a wet jet mill, and the like.

The amount of the colorant is preferably from 1 part by mass to 10 parts by mass, and more preferably from 5 parts by mass to 50 parts by mass per 100 parts by mass of the resin component in the toner particle.

A pigment dispersing agent can be also added when dispersing the pigment.

Examples of the pigment dispersing agent include hydroxyl group-containing carboxylic acid esters, salts of long-chain polyaminoamides and high-molecular acid esters, salts of high-molecular polycarboxylic acids, high-molecular unsaturated acid esters, high-molecular copolymers, modified polyacrylates, aliphatic polycarboxylic acids, naphthalenesulfonic acid-formalin polycondensate, polyoxyethylene alkylphosphoric acid esters, pigment derivatives, and the like. Commercial polymer dispersing agents such as Solsperse series (Japan Lubrizol Corp.) can be also preferably used.

Further, synergists corresponding to various pigments can be also used as pigment dispersion aids.

The amount added of these pigment dispersing agents and pigment dispersion aids is preferably from 1 part by mass to 50 parts by mass per 100 parts by mass of the pigment.

The liquid developer includes a polymer having a primary amino group and soluble in the carrier liquid. The "primary amino group", as referred to herein, means a group represented by $—NH_2$.

An indicator of "solubility in the carrier liquid" is that the soluble polymer having a primary amino group dissolves in 100 parts by mass of the carrier liquid at a temperature of 25° C. is at least about 10 parts by mass.

The volume resistivity of the liquid developer is affected not only by the volume resistivity of the carrier liquid, but also by the concentration of the polymer having a primary amino group which has separated in the carrier liquid.

The polymer having a primary amino group may be provided with a substituent for increasing the solubility in the carrier liquid with the object of demonstrating sufficient repulsion in the carrier liquid. In such a case, dispersion stability of the toner particles is improved.

Meanwhile, in some cases the polymer having a primary amino group, which is not sufficiently bonded to the polyester resin in the toner particle, is not adsorbed to the toner particle and is separated into the carrier liquid, thereby reducing the volume resistivity of the liquid developer.

However, when the toner particle in the liquid developer has a polyester resin having an acid value of at least 5 mg KOH/g, and the pKa of the acidic group of the polyester resin is not more than 3.4, bonding of the polymer having a primary amino group and the polyester resin is strengthened. As a result, separation of the polymer having a primary amino group into the carrier liquid is suppressed and the decrease in the volume resistivity of the liquid developer is suppressed.

Further, it was understood that the bonding force of the polymer having a primary amino group at a position other than the end of the main chain of the polymer and a polyester resin having a specific acid value is much stronger than that of the polymer having a primary amino group only at the end of the main chain of the polymer or a polymer having a secondary or tertiary amino group.

Therefore, in the structure of the polymer having a primary amino group, the primary amino group is at a position other than the end of the main chain of the polymer.

Further, the polymer having a primary amino group is not inclusive of a polymer having a primary amino group only at the end of the main chain of the polymer.

However, a primary amino group may be present at the end of the main chain, provided that a primary amino group is present at a position other than the end of the main chain of the polymer.

It is preferable that the polymer having a primary amino group having a monomer unit represented by Formula (1) below and a monomer unit represented by Formula (2) below.

Further, the polymer having a primary amino group has the monomer unit represented by Formula (1) below at a position other than the end of the main chain. Thus, a polymer having a primary amino group only at the end of the main chain of the polymer is not included. However, the monomer unit represented by Formula (1) may be present at the end of the main chain of the polymer, provided that the monomer unit represented by Formula (1) is present at a position other than the end of the main chain.

Furthermore, an amine value derived from the primary amino group included in the monomer unit represented by Formula (1) below is preferably at least 50% of the amine value of the polymer having a primary amino group.

$$\text{-}(K)\text{-} \quad (1)$$

Where, K represents a monomer unit having a primary amino group.

$$\text{-}(Q)\text{-} \quad (2)$$

Where, Q represents a monomer unit having an optionally substituted alkyl group having at least 6 carbon atoms, an optionally substituted cycloalkyl group having at least 6 carbon atoms, an optionally substituted alkylene group having at least 6 carbon atoms, or an optionally substituted cycloalkylene group having at least 6 carbon atoms.

The optionally substituted alkyl group having at least 6 carbon atoms or the optionally substituted cycloalkyl group having at least 6 carbon atoms in the Q in Formula (2) means an alkyl group or a cycloalkyl group with the number n of carbon atoms of at least 6, which is represented by linear $—C_nH_{2n+1}$ or cyclic $—C_nH_{2n-1}$ Further, the optionally substituted alkylene group having at least 6 carbon atoms or the optionally substituted cycloalkylene group having at least 6 carbon atoms means an alkylene group or a cycloalkylene group with the number n of carbon atoms of at least 6, which is represented by linear $—C_nH_{2n}—$ or cyclic $—C_nH_{2n-2}—$.

Among them, from the standpoint of affinity for the carrier liquid, it is more preferable that the number n of carbon atoms be at least 12. The upper limit of the number n of carbon atoms is preferably not more than 30, and more preferably not more than 22. Further, at least one hydrogen atom in the alkyl group, cycloalkyl group, alkylene group, or cycloalkylene group may be substituted.

The substituent that may be present in the alkyl group, cycloalkyl group, alkylene group, or cycloalkylene group in the Q is not particularly limited and can be exemplified by an alkyl group, an alkoxy group, a halogen atom, an amino group, a hydroxyl group, a carboxyl group, a carboxylic acid ester group, a carboxylic acid amide group, and the like.

The monomer unit represented by Formula (1) is more preferably a monomer unit represented by Formula (3) below.

(3)

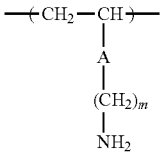

Where, A is a single bond, an alkylene group having from 1 to 6 carbon atoms (preferably, from 1 to 3 carbon atoms), or phenylene; m represents an integer from 0 to 3.

The monomer unit represented by Formula (1) is more preferably a monomer unit represented by Formula (4) below.

(4)

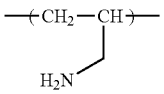

Meanwhile, the monomer unit represented by Formula (2) is more preferably a monomer unit represented by Formula (5) below.

(5)

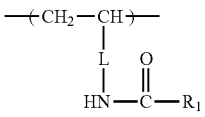

Where, $R_1$ is an optionally substituted alkyl group having at least 6 carbon atoms, or an optionally substituted cycloalkyl group having at least 6 carbon atoms; L is a divalent linking group.

$R_1$ is an alkyl group or a cycloalkyl group with the number n of at least 6, which is represented by linear $—C_nH_{2n+1}$ or cyclic $—C_nH_{2n-1}$.

It is more preferable that the n be at least 12. Meanwhile, the upper limit of n is preferably not more than 30, and more preferably not more than 22.

Further, the substituent that may be present in the $R_1$ is not particularly limited and can be exemplified by an alkyl group, an alkoxy group, a halogen atom, an amino group, a hydroxyl group, a carboxyl group, a carboxylic acid ester group, a carboxylic acid amido group, and the like.

L represents a divalent linking group and is preferably an alkylene group having from 1 to 6 carbon atoms (more preferably an alkylene group having from 1 to 3 carbon atoms), an alkenylene group having from 1 to 6 carbon atoms (more preferably an alkenylene group having from 1 to 3 carbon atoms), and an arylene group having from 6 to 10 carbon atoms.

The monomer unit represented by Formula (2) is more preferably a monomer unit represented by Formula (6) below.

(6)

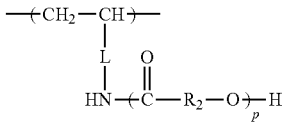

Where, $R_2$ is an optionally substituted alkylene group having at least 6 carbon atoms or an optionally substituted cycloalkylene group having at least 6 carbon atoms. p is an integer of at least 1 (preferably from 2 to 20). L represents a divalent linking group.

$R_2$ means an alkylene group or a cycloalkylene group with at least 6 carbon atoms, which is represented by linear $—C_nH_{2n}—$ or cyclic $—C_nH_{2n-1}—$. It is more preferable that the number of carbon atoms in the alkylene group or cycloalkylene group be at least 12. Meanwhile, the upper limit of the number of carbon atoms is preferably not more than 30, and more preferably not more than 22.

Further, the substituent that may be present in the $R_2$ is not particularly limited and can be exemplified by an alkyl group, an alkoxy group, a halogen atom, an amino group, a hydroxyl group, a carboxyl group, a carboxylic acid ester group, a carboxylic acid amido group, and the like.

Further, the preferred examples of L are the same as in Formula (5).

The monomer unit represented by Formula (1) and the monomer unit represented by Formula (2) can be a combination of arbitrary monomer units.

The polymer having a primary amino group is preferably a polyallylamine derivative including a monomer unit represented by Formula (4) in the polymer.

The average number of monomer units represented by Formula (4) which are included in one molecule of the polyallylamine derivative is preferably from 10 to 200, more preferably from 20 to 150, and even more preferably from 50 to 150.

Furthermore, the polymer having a primary amino group is more preferably a polyallylamine derivative including a monomer unit represented by Formula (4) and a monomer unit represented by Formula (6) in one polymer.

The molar ratio of the monomer unit represented by Formula (4) and the monomer unit represented by Formula (6) [(monomer unit represented by Formula (4)): (monomer unit represented by Formula (6))] in the polymer is preferably from 10:90 to 90:10, and more preferably from 50:50 to 80:20.

A reaction product of polyallylamine and a self-condensate of 12-hydroxystearic acid is more preferred.

The polyallylamine derivative can be produced by a well-known method, for example, a method disclosed in Japanese Patent No. 3718915.

Further, when the polyallylamine derivative is produced, commercially available polyamine compounds and polyamine compound solutions may be used. Examples thereof include PAA-01, PAA-03, PAA-05, PAA-08, PAA-15, PAA-15C, PAA-25, and PAA-03E (manufactured by Nittobo Medical Co., Ltd.).

The amine value of the polymer having a primary amino group is preferably from 10 mg KOH/g to 200 mg KOH/g, more preferably from 20 mg KOH/g to 100 mg KOH/g, even more preferably from 30 mg KOH/g to 100 mg KOH/g, and particularly preferably from 60 mg KOH/g to 100 mg KOH/g. It is conceivable that when the amine value is within the abovementioned ranges, the amino group of the polymer forms sufficient ion bonds with the acidic group of the polyester resin.

Further, the total amount of the acid value contained in the toner particle in the liquid developer is preferably larger than the total amount of the amine value.

In the abovementioned case, the presence amount of the polymer having a primary amino group which is not bonded to the polyester resin decreases, the amount of the polymer having a primary amino group which has separated into the carrier liquid tends to decrease, and the decrease in the volume resistivity of the liquid developer can be suppressed.

The SP value of the polymer having a primary amino group is preferably from 7.0 to 9.0, and more preferably from 7.0 to 8.5.

From the viewpoint of dispersion stability of the toner particle, it is preferable that the number average molecular weight (Mn) of the polymer having a primary amino group be from 5,000 to 300,000, more preferably from 10,000 to 200,000.

The amount of the polymer having a primary amino group is preferably from 0.5 parts by mass to less than 100 parts by mass, more preferably from 1.0 parts by mass to 30.0 parts by mass, and even more preferably from 1.0 part by mass to 10.0 parts by mass per 100 parts by mass of the polyester resin.

When a polymerizable liquid compound is used in the carrier liquid, a reaction called "initiation reaction" is needed to initiate the polymerization reaction of the polymerizable liquid compound. A substance used therefor is called a polymerization initiator.

When the polymerizable liquid compound is a component that can be polymerized by a photopolymerization reaction, a photopolymerization initiator which generates an acid and a radical in response to light of a predetermined wavelength may be used.

From the viewpoint of suppressing the decrease in volume resistivity of the polymerizable liquid compound, for example, a photopolymerization initiator represented by Formula (9) below can be used.

(7)

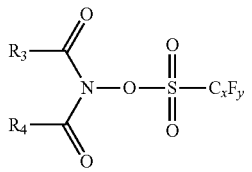

Where, $R_3$ and $R_4$ bond to each other to form a ring structure; x indicates an integer of from 1 to 8, and y indicates an integer of from 3 to 17.

Such a photopolymerization initiator is photo-decomposed by UV radiation and generates a sulfonic acid which is a strong acid. Further, it is also possible to use additionally a sensitizer and to trigger the decomposition of the polymerization initiator and generation of a sulfonic acid by absorption of UV radiation by the sensitizer.

The ring structure formed by $R_3$ and $R_4$ bonded to each other can be exemplified by a five-member ring and a six-member ring. Specific examples of the ring structure formed by $R_3$ and $R_4$ bonded to each other include a succinic acid imido structure, a phthalic acid imido structure, a norbornenecarboxyimido structure, a naphthalenedicarboxyimido structure, a cyclohexanedicarboxyimido structure, an epoxycyclohexenedicarboxyimido structure, and the like.

The ring structure may have an alkyl group, an alkyloxy group, an alkylthio group, an aryl group, an aryloxy group, an arylthio group, or the like as a substituent.

A $C_xF_y$ group having a strong electron-withdrawing character is a fluorocarbon group and is a functional group for decomposing a sulfonic acid ester portion by UV irradiation. The number of carbon atoms is preferably from 1 to 8 (x is from 1 to 8), and the number of fluorine atoms is preferably from 3 to 17 (y is from 3 to 17).

The $C_xF_y$ in Formula (7) can be exemplified by a linear alkyl group in which a hydrogen atom is substituted with a fluorine atom (RF1), a branched alkyl group in which a hydrogen atom is substituted with a fluorine atom (RF2), a cycloalkyl group in which a hydrogen atom is substituted with a fluorine atom (RF3), and an aryl group in which a hydrogen atom is substituted with a fluorine atom (RF4).

The linear alkyl group in which a hydrogen atom is substituted with a fluorine atom (RF1) can be exemplified by a trifluoromethyl group (x=1, y=3), a pentafluoroethyl group (x=2, y=5), a heptafluoro-n-propyl group (x=3, y=7), a nonafluoro-n-butyl group (x=4, y=9), a perfluoro-n-hexyl group (x=6, y=13), and a perfluoro-n-octyl group (x=8, y=17).

The branched alkyl group in which a hydrogen atom is substituted with a fluorine atom (RF2) can be exemplified by a perfluoroisopropyl group (x=3, y=7), a perfluoro-tert-butyl group (x=4, y=9), and perfluoro-2-ethylhexyl group (x=8, y=17).

The cycloalkyl group in which a hydrogen atom is substituted with a fluorine atom (RF3) can be exemplified by a perfluorocyclobutyl group (x=4, y=7), a perfluorocyclopentyl group (x=5, y=9), a perfluorocyclohexyl group (x=6, y=11), and a perfluoro(1-cyclohexyl)methyl group (x=7, y=13).

The aryl group in which a hydrogen atom is substituted with a fluorine atom (RF4) can be exemplified by a pentafluorophenyl group (x=6, y=5) and a 3-trifluoromethyltetrafluorophenyl group (x=7, y=7).

Among the $C_xF_y$ in Formula (7), from the viewpoint of availability and ability to decompose a sulfonic acid ester portion, the linear alkyl group (RF1), branched alkyl group (RF2), and aryl group (RF4) are preferred. The linear alkyl group (RF1) and aryl group (RF4) are more preferred. A trifluoromethyl group (x=1, y=3), a pentafluoroethyl group (x=2, y=5), a heptafluoro-n-propyl group (x=3, y=7), a nonafluoro-n-butyl group (x=4, y=9), and a pentafluorophenyl group (x=6, y=5) are even more preferred.

The photopolymerization initiators can be used singly or in combination of two or more thereof.

The amount of the photopolymerization initiator is not particularly limited and is preferably from 0.01 parts by mass to 5 parts by mass, more preferably 0.05 parts by mass to 1 part by mass, and even more preferably from 0.1 parts by mass to 0.5 parts by mass per 100 parts by mass of the polymerizable liquid compound.
Specific compounds (exemplary compounds B-1 to B-27) of the photopolymerization initiator represented by Formula (7) are presented below, but the present invention is not limited to these examples.
(B-1)
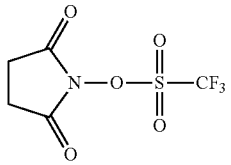
(B-2)
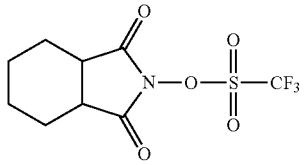
(B-3)
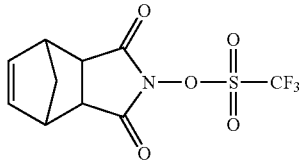
(B-4)
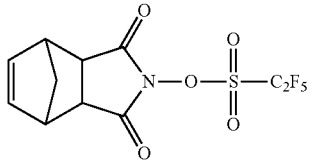
(B-5)
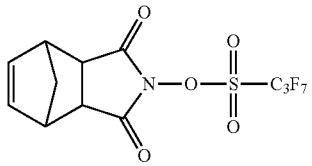
(B-6)
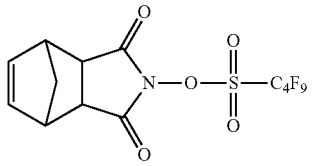
(B-7)
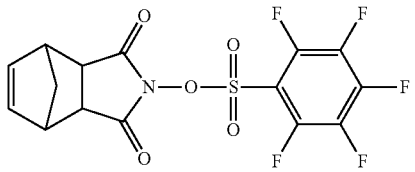
(B-8)
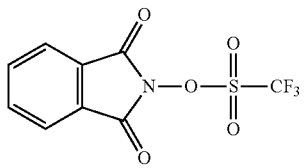
-continued
(B-9)
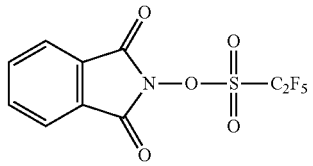
(B-10)
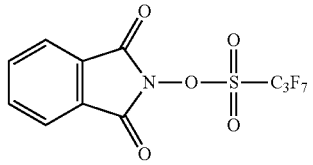
(B-11)
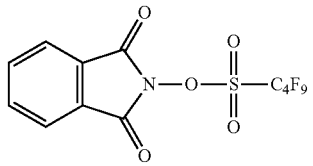
(B-12)
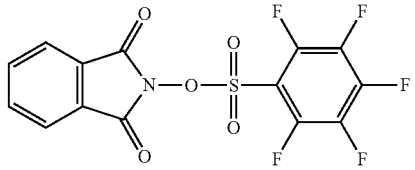
(B-13)
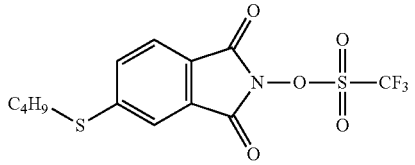
(B-14)
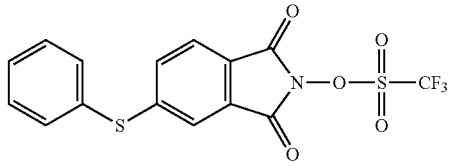
(B-15)
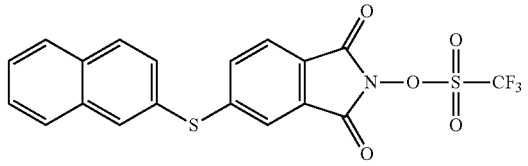
(B-16)
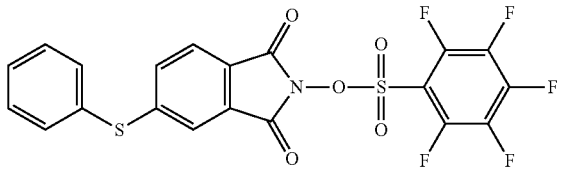

-continued (B-17)

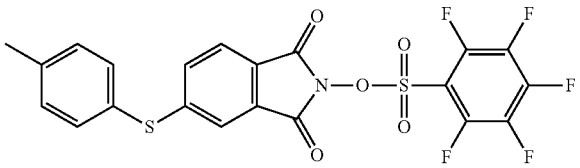

(B-18)

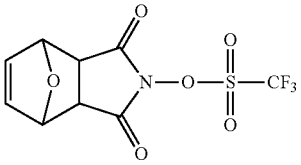

(B-19)

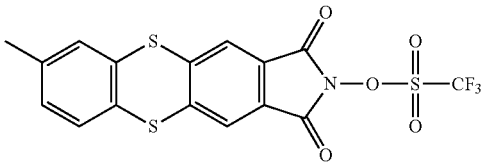

(B-20)

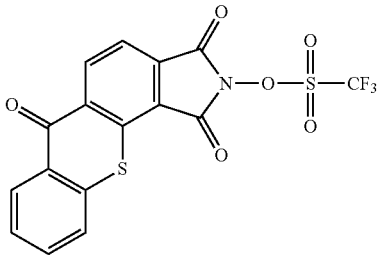

(B-21)

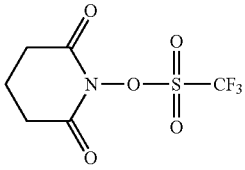

(B-22)

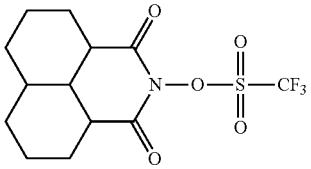

(B-23)

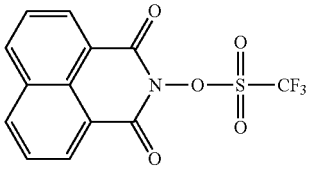

(B-24)

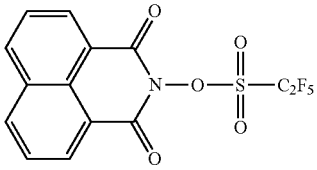

-continued (B-25)

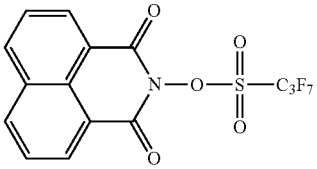

(B-26)

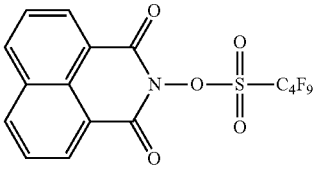

(B-27)

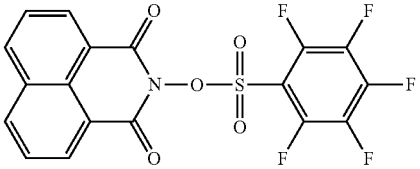

<Sensitizer and Sensitization Aid>

The liquid developer may include, as necessary, a sensitizer with the object of improving the acid generation efficiency of the photopolymerization initiator and extend the sensitivity wavelength to longer wavelengths.

The sensitizer is not particularly limited, provided that the photopolymerization initiator is sensitized by an electron transfer mechanism or an energy transfer mechanism.

Specific examples of the sensitizer include aromatic multiple condensed ring compounds such as anthracene, 9,10-dialkoxyanthracene, pyrene, perylene, and the like, aromatic ketone compounds such as acetophenone, benzophenone, thioxanthone, Michler's ketone, and the like, and heterocyclic compounds such as phenothiazine, N-aryloxazolidinone, and the like.

The amount of the sensitizer is appropriately selected according to the object and is typically from 0.1 parts by mass to 10 parts by mass and preferably from 1 part by mass to 5 parts by mass per 1 part by mass of the photopolymerization initiator.

Further, the liquid developer may further include a sensitization aid with the object of improving the electron transfer efficiency or energy transfer efficiency between the sensitizer and the photopolymerization initiator.

Specific examples of the sensitization aid include naphthalene compounds such as 1,4-dihydroxynaphthalene, 1,4-dimethoxynaphthalene, 1,4-diethoxynaphthalene, 4-methoxy-1-naphthol, and 4-ethoxy-1-napthol, and benzene compounds such as 1,4-dihydroxybenzene, 1,4-dimethoxybenzene, 1,4-diethoxybenzene, 1-methoxy-4-phenol, and 1-ethoxy-4-phenol.

The amount of the sensitization aid is appropriately selected according to the object and is preferably from 0.1 parts by mass to 10 parts by mass and more preferably from 0.5 parts by mass to 5 parts by mass per 1 part by mass of the sensitizer.

The liquid developer may include, as necessary, a charge control agent. A well-known charge control agent can be used.

Specific compounds are presented hereinbelow.

Oils and fats such as linseed oil and soybean oil; alkyd resins, halogen polymers, aromatic polycarboxylic acids, acidic group-containing water-soluble dyes, oxidative condensates of aromatic polyamines, metallic soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexanoate; metal sulfonates such as petroleum-based metal sulfonates and metallic salts of sulfosuccinates; phospholipids such as lecithin and hydrogenated lecithin; metal salicylates such as t-butylsalicylic acid metal complexes; polyvinylpyrrolidone resins, polyamide resins, sulfonic acid-containing resins, and hydroxybenzoic acid derivatives.

The toner particle can include a charging auxiliary agent with the object of adjusting the charging performance of the toner particle. A known charging auxiliary agent can be used.

Examples of specific compounds include metallic soaps such as zirconium naphthenate, cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, aluminum tristearate, and cobalt 2-ethylhexanoate; metal sulfonates such as petroleum-based metal sulfonates and metal salts of sulfosuccinate esters; phospholipids such as lecithin and hydrogenated lecithin; metal salicylates such as t-butylsalicylic acid metal complexes; polyvinylpyrrolidone resins, polyamide resins, sulfonic acid-containing resins, and hydroxybenzoic acid derivatives.

Further, an aluminum complex of a salicylic acid compound (BONTRON E-108, manufactured by Orient Chemical Industries Co., Ltd.), a chromium complex of a salicylic acid compound (BONTRON E-81, manufactured by Orient Chemical Industries Co., Ltd.), and a zinc complex of a salicylic acid compound (BONTRON E-84, manufactured by Orient Chemical Industries Co., Ltd.) can be also used.

The amount of the charging auxiliary agent is preferably from 0.01 parts by mass to 10.0 parts by mass, and more preferably from 0.05 parts by mass to 5.0 parts by mass with respect to 100 parts by mass of the toner particle (solid fraction).

In addition to those described above, various known additives may be used, as necessary, with the object of improving compatibility with recording media, storage stability, image storability, and other characteristics.

For example, a surfactant, a lubricant, a filler, an antifoaming agent, an ultraviolet absorber, an antioxidant, an anti-fading agent, a fungicide, an anticorrosion agent, and the like, can be selected as appropriate and used as various additives.

A method of producing the liquid developer is not particularly limited, and a well-known method, for example, the below-described coacervation method, wet pulverization method, miniemulsion polymerization method, and the like can be used.

In a typical production method, for example, a resin and other additives as well as a dispersion medium are mixed and pulverized using a bead mill or the like to obtain a toner particle dispersion. The obtained toner particle dispersion and a carrier liquid and the like are mixed to obtain a curable liquid developer.

The coacervation method is described in detail, for example, in Japanese Patent Application Publication No. 2003-241439, WO 2007/000974, and WO 2007/000975.

In the coacervation method, a resin, a solvent for dissolving the resin, a toner particle dispersing agent (for example, the polymer having a primary amino group), and a solvent that does not dissolve the resin (for example, a carrier liquid) are mixed and the solvent that dissolves the resin is removed from the mixed liquid to precipitate the resin that was in the dissolved state, thereby making it possible to disperse the toner particles in the solvent that does not dissolve the resin.

Meanwhile, the wet pulverization method is described in detail, for example, in WO 2006/126566 and WO 2007/108485.

In the wet pulverization method, a resin and other additives are kneaded at a temperature equal to or higher than the melting point of the resin and then dry pulverized, and the obtained pulverized material and a toner particle dispersing agent are wet pulverized in a carrier liquid, thereby making it possible to disperse the toner particles in the carrier liquid.

In the coacervation method, the particle diameter of the toner particle and the dispersion stability of toner particles can be easily controlled.

The method of producing a liquid developer according to the present invention is a method of producing a liquid developer including a carrier liquid, a toner particle insoluble in the carrier liquid, and a polymer having a primary amino group and soluble in the carrier liquid, the method comprising:

(i) a step of preparing a resin-dispersed solution including a polyester resin having an acidic group, a polymer having a primary amino group, and a solvent dissolving the polyester resin;

(ii) a step of preparing a mixed liquid including the resin-dispersed solution and the carrier liquid; and (iii) a step of distilling off the solvent from the mixed liquid, wherein an acid value of the polyester resin having an acidic group is at least 5 mg KOH/g;

a pKa of the acidic group is not more than 3.4; and the polymer having a primary amino group has a primary amino group at a position other than the end of a main chain of the polymer.

A solvent that can be used in the step (i) is not particularly limited, provided that the solvent dissolves the polyester resin.

Here, an indicator of "the solvent dissolving the polyester resin" is that the polyester resin dissolves in 100 parts by mass of the solvent at a temperature of 25° C. is about at least 333 parts by mass.

Examples of the solvent include ethers such as tetrahydrofuran, ketones such as methyl ethyl ketone and cyclohexanone, esters such as ethyl acetate, and halogen compounds such as chloroform. Aromatic hydrocarbons such as toluene and benzene may be also used when the polyester resin can be dissolved.

In the step (ii), a mixed liquid of the resin-dispersed solution and the carrier liquid is prepared, but a solvent that does not dissolve the polyester resin, the solvent being other than the carrier liquid, may be also used.

Here, an indicator of "the solvent that does not dissolve the polyester resin" is that the polyester resin dissolves in 100 parts by mass of the solvent at a temperature of 25° C. is not more than 1 part by mass.

When the toner particle is generated by using the solvent that does not dissolve the polyester resin, the liquid developer can be produced by a method of adding the carrier liquid after the toner particle has been generated or by a method of replacing the solvent with the carrier liquid.

Thus, the method of producing a liquid developer may be a method of producing a liquid developer including a carrier liquid, a toner particle insoluble in the carrier liquid, and a polymer having a primary amino group and soluble in the carrier liquid, the method comprising:

(I) a step of preparing a resin-dispersed solution including a polyester resin having an acidic group, a polymer having a primary amino group, and a solvent dissolving the polyester resin;

(II) a step of preparing a first mixed liquid including the resin-dispersed solution and a solvent that does not dissolve the polyester resin, the solvent being other than the carrier liquid;

(III) a step of preparing a toner particle dispersion by distilling off the solvent dissolving the polyester resin from the first mixed liquid; and (IV) a step of preparing a second mixed liquid including the toner particle dispersion and the carrier liquid, wherein an acid value of the polyester resin having an acidic group is at least 5 mg KOH/g;

a pKa of the acidic group is not more than 3.4; and the polymer having a primary amino group has a primary amino group at a position other than the end of a main chain of the polymer.

A liquid developer may be also obtained by adding, as necessary, additives such as a photopolymerization initiator and a charge control agent after the step (III) or the step (IV).

Further, the volume resistivity of the liquid developer is preferably from $5\times10^{8}$ Ω·cm to $1\times10^{15}$ Ω·cm, and more preferably from $1\times10^{9}$ Ω·cm to $1\times10^{13}$ Ω·cm.

The liquid developer can be suitably used in a general image forming apparatus of an electrophotographic system.

Measuring methods used in the examples are described hereinbelow.

<Method of Measuring Molecular Weight of Resin and the Like>

A weight average molecular weight (Mw) and a number average molecular weight (Mn) of the resin and the like are calculated by using gel permeation chromatography (GPC) on the basis of polystyrene. The molecular weight is measured by GPC in the following manner.

A sample is added to the below-described eluate to obtain a sample concentration of 1.0% by mass and allowed to stand for 24 h at room temperature to dissolve the sample. The solvent is filtered with a solvent-resistance membrane filter with a pore diameter of 0.20 μm to obtain a sample solution. The measurements are conducted under the following conditions.

Device: high-speed GPC device "HLC-8220GPC" (manufactured by Tosoh Corp.).

Column: two LF-804 columns.

Eluate: tetrahydrofuran (THF).

Flow velocity: 1.0 mL/min.

Oven temperature: 40° C.

Sample injection amount: 0.025 mL.

A molecular weight calibration curve plotted by using reference polystyrene resins (TSK Standard Polystyrene F-850, F-450, F-288, F-128, F-80, F-40, F-20, F-10, F-4, F-2, F-1, A-5000, A-2500, A-1000, and A-500) is used when calculating the molecular weight of the sample.

<Method of Measuring Acid Value and pKa>

Basic operations performed when measuring the acid value conform to JIS K-0070.

Specifically, the measurements are performed by the following method.

(1) A sample (0.5 to 2.0 g) is weighed. A mass at this time is denoted by M1 (g).

(2) The sample is placed in a 50 mL beaker and dissolved by adding 25 mL of a mixed liquid of tetrahydrofuran/ethanol (2/1).

(3) Titration is performed at 25° C. by using a 0.1 mol/L ethanol solution of KOH and a potentiometric titrator (automatic titrator "COM-2500", manufactured by Hiranuma Sangyo Co., Ltd.).

(4) The amount used of the KOH solution at this time is denoted by A (mL). At the same time, a blank is measured and the amount used of KON at this time is denoted by B1 (mL).

(5) An acid value is calculated by the following formula. Here, f is a factor of the KOH solution.

Acid value [mg KOH/g]=(A−B1)×f×5.61/M1.

Further, a pKa at 25° C. is determined by curve fitting using a least square method with a theoretical formula of acid dissociation equilibrium with respect to the titration curve obtained at this time.

<Method of Measuring Amine Value>

Basic operations performed when measuring an amine value conform to ASTM D2074.

Specifically, the measurements are performed by the following method.

(1) A sample (0.5 to 2.0 g) is weighed. A mass at this time is denoted by M2 (g).

(2) The sample is placed in a 50 mL beaker and dissolved by adding 25 mL of a mixed liquid of tetrahydrofuran/ethanol (3/1).

(3) Titration is performed at 25° C. by using a 0.1 mol/L ethanol solution of HCl and a potentiometric titrator (automatic titrator "COM-2500", manufactured by Hiranuma Sangyo Co., Ltd.).

(4) The amount used of the HCl solution at this time is denoted by S (mL). At the same time, a blank is measured and the amount used of HCl at this time is denoted by B2 (mL).

(5) An amine value is calculated by the following formula. Here, f is a factor of the HCl solution.

Amine value [mg KOH/g]=(S−B2)×f×5.61/M2

<Method of Measuring Acid Value and pKa of Polyester Resin and Amine Value of Polymer Having Primary Amino Group Contained in Toner Particle from Liquid Developer>

A method of measuring the acid value and pKa of the polyester resin and the amine value of the polymer having a primary amino group, which are contained in the toner particle in the liquid developer, is described hereinbelow.

(1) About 10 g of the liquid developer is centrifugally separated, a toner particle is precipitated and the supernatant is discarded.

(2) Hexane is added to the toner particle and centrifugal separation is performed after sufficient stirring. The toner particle is precipitated and the supernatant is discarded. The operation is repeated three times, followed by sufficient drying.

(3) A total of 10 g of tetrahydrofuran is added to (2), and the sample is allowed to stand overnight. Centrifugal separation is performed after sufficient stirring and tetrahydrofuran-insoluble components are removed. A tetrahydrofuran-soluble component of the supernatant (a mixture of the resin and the polymer having a primary amino group) is sufficiently dried.

(4) The acid value and pKa as well as the amine value are measured by the above-described methods by using the tetrahydrofuran-soluble component obtained in (3).

Further, if necessary, (i) the toner particle obtained in (2) hereinabove is dissolved in heavy chloroform and composition analysis of the polyester resin and the composition analysis of the polymer having a primary amino group, which constitute the toner particle, are performed using a Fourier transform nuclear magnetic resonance device JNM-ECA ('H-NMR), manufactured by JEOL Corp.

(ii) A number average molecular weight (Mn) of the tetrahydrofuran-soluble component obtained in (3) hereinabove is calculated using gel permeation chromatography (GPC), and the number average degree of polymerization of the polyester resin and the average degree of polymerization of the polymer having a primary amino group are calculated from the results obtained in (i) and (ii).

<Method of Measuring Volume Resistivity>

The volume resistivity is measured by using a Digital Ultra High Resistance/Micro Current Meter R8340A (manufactured by ADC Corporation), placing 25 mL of the sample in a liquid sample electrode SME-8330 (manufactured by Hioki E.E. Corporation), and applying a DC current of 1000 V at a room temperature of 25° C.

EXAMPLES

The present invention is described hereinbelow in greater detail by Examples, but the present invention is not limited to these Examples. Here, "parts" and "%" are assumed to means "parts by mass" and "% by mass", respectively, unless specifically stated otherwise.

[Production Examples of Polyester Resin]

<Production Example of Polyester Resin (PES-1)>

The below-described materials were added into a reaction vessel equipped with a stirrer, a thermometer, and a reflux cooler, and a transesterification reaction was performed over 2 h at 220° C.

A total of 88 parts of terephthalic acid, 110 parts of isophthalic acid, 285 parts of a 2-mole ethylene oxide adduct of bisphenol A, 65 parts of ethylene glycol, 41 parts of neopentyl glycol, 0.1 part of n-tetrabutyl titanate as a catalyst, 2 parts of IRGANOX 1330 (BASF) as an antioxidant, and 0.3 part of sodium acetate as a polymerization stabilizer.

The reaction system was then depressurized while raising the temperature of the reaction system from 220° C. to 270° C., and a polycondensation reaction was then conducted for 9 h under 1 Torr.

After completion of the reaction, the system was returned from vacuum to normal pressure by using nitrogen.

Further, 28 g of trimellitic anhydride (denoted as "acidic group-imparting compound" in the tables) was then loaded to impart the polyester resin with an acidic group, and a reaction was conducted for 30 min at 220° C.

A total of 100 parts of the obtained polyester resin was dissolved in 200 parts of chloroform and placed together with 300 parts of ion exchanged water into a fractionation funnel, stirred and allowed to stand. The supernatant was discarded.

The lower layer was washed twice with water, and chloroform was then distilled off with an evaporator to obtain a polyester (PES-1).

<Production Examples of Polyester Resins (PES-2) to (PES-9)>

Polyester resins (PES-2) to (PES-9) were obtained in the same manner as in the production example of the polyester resin (PES-1), except that the types, amounts added, and reaction conditions of the monomers were changed to those shown in Table 1-1.

Physical properties of the polyester resins are shown in Table 1-2.

<Production Examples of Polyester Resins (PES-101) and (PES-102)>

A polyester resin (PES-101) was obtained in the same manner as in the production example of the polyester resin (PES-2), except that the types, amounts added, and reaction conditions of the monomers were changed to those shown in Table 1-1, and a step of loading the trimellitic anhydride and conducting the reaction for 30 min at 220° C. was omitted.

A polyester resin (PES-102) was obtained in the same manner as in the production example of the polyester resin (PES-2), except that the types, amounts added, and reaction conditions of the monomers were changed to those shown in Table 1-1.

TABLE 1-1

| | | | | | | n-Tetrabutyl | Polycondensation | Acidic group-imparting compound | | | |
|---|---|---|---|---|---|---|---|---|---|---|---|
| | BPA-EO | EG | NPG | TPA | IPA | titanate | time (h) | TMA | DHTPA | DHIPA | PA |
| PES-1 | 285 | 65 | 41 | 88 | 110 | 0.1 | 9 | 28 | — | — | — |
| PES-2 | 285 | 65 | 41 | 88 | 110 | 0.9 | 13 | 28 | — | — | — |
| PES-3 | 285 | 65 | 41 | 88 | 110 | 0.5 | 30 | 28 | — | — | — |
| PES-4 | 285 | 65 | 41 | 88 | 110 | 0.1 | 6 | 28 | — | — | — |
| PES-5 | 300 | — | — | 125 | — | 0.1 | 10 | 18 | — | — | — |
| PES-6 | 300 | — | — | 125 | — | 0.1 | 5 | 18 | — | — | — |
| PES-7 | 285 | 65 | 41 | 88 | 110 | 0.1 | 9 | — | 28 | — | — |
| PES-8 | 285 | 65 | 41 | 88 | 110 | 0.1 | 9 | — | — | 28 | — |
| PES-9 | 285 | 65 | 41 | 88 | 110 | 0.1 | 9 | — | — | — | 28 |
| PES-101 | 285 | 65 | 41 | 88 | 110 | 0.1 | 12 | — | — | — | — |
| PES-102 | 285 | 130 | 41 | 88 | 110 | 0.1 | 10 | 28 | — | — | — |

TABLE 1-2

| | | | | | | Acidic group-imparting compound | | | | | | Acid value |
|---|---|---|---|---|---|---|---|---|---|---|---|---|
| | BPA-EO | EG | NPG | TPA | IPA | TMA | DHTPA | DHIPA | PA | Mn | pKa | (mg KOH/g) |
| PES-1 | 6 | 3 | 1 | 4 | 5 | 1 | — | — | — | 3,700 | 3.2 | 14 |
| PES-2 | 6 | 3 | 1 | 4 | 5 | 1 | — | — | — | 4,900 | 3.2 | 14 |
| PES-3 | 6 | 3 | 1 | 4 | 5 | 1 | — | — | — | 10,000 | 3.2 | 10 |
| PES-4 | 6 | 3 | 1 | 4 | 5 | 1 | — | — | — | 2,900 | 3.2 | 14 |
| PES-5 | 10 | — | — | 9 | — | 1 | — | — | — | 4,000 | 3.2 | 14 |

TABLE 1-2-continued

| | BPA-EO | EG | NPG | TPA | IPA | Acidic group-imparting compound TMA | DHTPA | DHIPA | PA | Mn | pKa | Acid value (mg KOH/g) |
|---|---|---|---|---|---|---|---|---|---|---|---|---|
| PES-6 | 10 | — | — | 9 | — | 1 | — | — | — | 2,600 | 3.2 | 14 |
| PES-7 | 6 | 3 | 1 | 4 | 5 | — | 1 | — | — | 3,800 | 2.5 | 14 |
| PES-8 | 6 | 3 | 1 | 4 | 5 | — | — | 1 | — | 3,800 | 3.1 | 14 |
| PES-9 | 6 | 3 | 1 | 4 | 5 | — | — | — | 1 | 3,800 | 2.8 | 14 |
| PES-101 | 6 | 3 | 1 | 4 | 5 | — | — | — | — | 4,700 | 3.8 | 14 |
| PES-102 | 6 | 3 | 1 | 4 | 5 | 1 | — | — | — | 4,000 | 3.2 | 2 |

The meaning of notations in Table 1-1 and Table 1-2 is explained hereinbelow.

BPA-EO: 2-mole ethylene oxide adduct of bisphenol A
EG: ethylene glycol
NPG: neopentyl glycol
TPA: terephthalic acid
IPA: isophthalic acid
TMA: trimellitic anhydride
DHTPA: 2,5-dihydroxyterephthalic acid
DHIPA: 4,6-dihydroxyisophthalic acid
Mn: number average molecular weight The numerical values indicated for each monomer of the polyester resins in Table 1-2 are the results (molar ratios) obtained by measuring the obtained polyester resins by NMR.

<Production Example of 12-Hydroxystearic Acid Self-Condensate (P-1)

A total of 30.0 parts of xylene (manufactured by Junsei Chemical Co., Ltd.), 300.0 parts of 12-hydroxystearic acid (manufactured by Junsei Chemical Co., Ltd.) and 0.1 part of tetrabutyl titanate (manufactured by Tokyo Chemical Industry Co., Ltd.) were loaded in a reaction flask equipped with a thermometer, a stirrer, a nitrogen introducing port, a reflux tube, and a water separator, and the temperature was raised to 160° C. over 4 h under a nitrogen gas flow.

Heating was then performed for 4 h at 160° C. (the acid value at this time was about 20 mg KOH/g) and xylene was distilled off at 160° C.

Next, cooling was performed to room temperature, water generated during the reaction under heating was separated from xylene in the distillate, and the xylene was refluxed to the reaction solution. The reaction liquid will be referred to hereinbelow as a 12-hydroxystearic acid self-condensate (P-1).

The polyester resin contained in the 12-hydroxystearic acid self-condensate (P-1) had the following properties: a number average molecular weight of 2550 and an acid value of 22.0 mg KOH/g.

The polyester resin produced as described hereinabove is used, in the form including a solvent (xylene), as a raw material for producing a polyallylamine derivative.

[Production Example of Polymer Having Primary Amino Group (also referred to hereinbelow simply as "polymer")]

<Production Example of Polymer (Dis-1)>

A total of 25.0 parts of xylene and 70.0 parts of a 10% aqueous solution of polyallylamine "PAA-1LV" (manufactured by Nittobo Medical Co., Ltd.), number average molecular weight (Mn): 3,000) were loaded in a reaction flask equipped with a thermometer, a stirrer, a nitrogen introducing port, a reflux pipe, and a water separator, and heated to 160° C. under stirring. A total of 69.6 parts of the 12-hydroxystearic acid self-condensate (P-1) was added to the reaction liquid while distilling off water with the separator and refluxing xylene to the reaction liquid (the amine value immediately after mixing was 86.5 mg KOH/g), and the reaction was conducted for 2 h at 160° C. to obtain a polymer (Dis-1) (amine value 70.0 mg KOH/g, reaction ratio [(86.5 mg KOH/g-70 mg KOH/g)/86.5 mg KOH/g=19%].

<Production Examples of Polymers (Dis-2) to (Dis-4)>

Polymers (Dis-2) to (Dis-4) were obtained in the same manner as in the production example of polymer (Dis-1), except that the type of polyallylamine, the amount added of the 12-hydroxystearic acid self-condensate (P-1), and the reaction ratio were changed to those shown in Table 2. Physical properties of each toner particle dispersion are shown in Table 2.

TABLE 2

| | Polyallylamine compound | Amount added of (P-1) (parts) | Amine value (mg KOH/g) | Reaction ratio (%) |
|---|---|---|---|---|
| Dis-1 | PAA-1LV | 69.6 | 70 | 19 |
| Dis-2 | PAA-1C | 69.6 | 35 | 60 |
| Dis-3 | PAA-1LV | 13.9 | 39 | 88 |
| Dis-4 | PAA-1LV | 69.6 | 20 | 77 |

In Table 2,

PAA-1C is a 10% aqueous solution of polyallylamine "PAA-1C" (manufactured by Nittobo Medical Co., Ltd., number average molecular weight (Mn): 10,000).

<Production Example of Polymer (Dis-5)>

A total of 8 parts of xylene and 10 parts of a 10% aqueous solution of polyallylamine "PAA-1LV" (manufactured by Nittobo Medical Co., Ltd., number average molecular weight (Mn): 3,000) were added to a flask equipped with a Dean-Stark tube, and stirring was performed while distilling off water at 160° C.

A mixture of 12 parts of stearic acid and 50 parts of xylene was heated to 160° C. and added to the flask, and the reaction was performed for 2 h at 160° C. to obtain a polymer (Dis-5) having an amine value of 70 mg KOH/g.

<Production Example of Charge Control Agent>

A total of 17.9 parts of 2-(methacryloyloxy)ethyl-2-(trimethylammonio)ethyl phosphate, 82.1 parts of octadecyl methacrylate, 4.1 parts of azobisisobutyronitrile, and 900 parts of n-butanol were charged into a reaction vessels equipped with a cooling tube, a stirrer, a thermometer, and a nitrogen introducing tube, and nitrogen bubbling was performed for 30 min.

The obtained reaction mixture was heated for 8 h at 65° C. under a nitrogen atmosphere to complete the polymerization reaction.

The reaction liquid was cooled to room temperature and the solvent was thereafter distilled off under reduced pressure.

The obtained residue was dissolved in chloroform and purified by dialysis with a dialysis membrane (manufactured by Spectrum Laboratories, Inc., Spectra/Por7 MWCO 1 kDa).

After the solvent was distilled off under reduced pressure, vacuum drying was performed under not more than 0.1 kPa at 50° C. to obtain a charge control agent (CD-1).

The weight average molecular weight (Mw) of the obtained charge control agent (compound CD-1) was 11,800, and the following structural formula was confirmed.

Compound (CD-1)

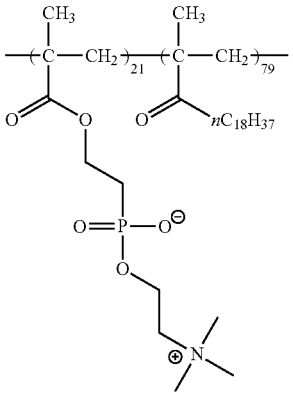

<Preparation of Charge Control Agent-Dispersed Solution (CD-1a)>

A total of 6.2 parts of the charge control agent (CD-1) and 68.2 parts of tetrahydrofuran were loaded in a reaction vessel equipped with a stirrer and a thermometer, the temperature was raised to 60° C., and the charge control agent (CD-1) was dissolved.

A total of 61.3 parts of MORESCO WHITE MT-30P (manufactured by MORESCO Corporation) was loaded and tetrahydrofuran was distilled off under reduced pressure of 4 kPa at 50° C. to obtain a charge control agent-dispersed solution (CD-1a) as a transparent reverse micelle solution.

<Preparation of Charge Control Agent-Dispersed Solution (CD-1b)>

A charge control agent-dispersed solution (CD-1b) was obtained in the same manner as in the preparation of the charge control agent-dispersed solution (CD-1a), except that MORESCO WHITE MT-30P was changed to dodecyl vinyl ether.

[Production Example of Liquid Developer by Wet Pulverization Method]

<Production Example of Liquid Developer (LD-1)>

A total of 36 parts of the polyester resin (PES-1), 9 parts of Pigment Blue 15:3, 15 parts of VYLON UR4800 (manufactured by Toyobo Corp., resin concentration 32%) were thoroughly mixed in a HENSCHEL MIXER. Melt kneading was then performed using a two-screw extruder (rotation in the same direction) with a heating temperature in a roll of 100° C., and the obtained mixture was cooled and coarsely pulverized to obtain coarsely pulverized toner particles.

Next, 160 parts of MORESCO WHITE MT-30P (manufactured by MORESCO Corporation, SP value: 7.90) as a carrier liquid, 40 parts of the coarsely pulverized toner particles obtained hereinabove, and 1.2 parts of the polymer (Dis-1) were mixed for 24 h with a sand mill to obtain a toner particle dispersion (T-1).

A total of 0.12 part of the charge control agent-dispersed solution (CD-1a) and 89.88 parts of MORESCO WHITE MT-30T were mixed with 10 parts of the toner particle dispersion (T-1) to obtain a liquid developer (LD-1).

<Production Examples of Liquid Developers (LD-2) to (LD-13)>

Liquid developers (LD-2) to (LD-13) were obtained in the same manner as in the production example of the liquid developer (LD-1), except that the types of the polyester resin, polymer having a primary amino group, and carrier liquid were changed to those shown in Table 3.

<Production Example of Liquid Developer (LD-14)>

A total of 36 parts of the polyester resin (PES-2), 9 parts of Pigment Blue 15:3, 15 parts of VYLON UR4800 (manufactured by Toyobo Corp., resin concentration 32%), and 0.6 part of BONTRON E-84 (manufactured by Orient Chemical Industries Co., Ltd.) were thoroughly mixed in a HENSCHEL MIXER. Melt kneading was then performed using a two-screw extruder (rotation in the same direction) with a heating temperature in a roll of 100° C., and the obtained mixture was cooled and coarsely pulverized to obtain coarsely pulverized toner particles.

Next, 160 parts of MORESCO WHITE MT-30P (manufactured by MORESCO Corporation, SP value: 7.90) as a carrier liquid, 40 parts of the coarsely pulverized toner particles obtained hereinabove, and 1.2 parts of the polymer (Dis-1) were mixed for 24 h with a sand mill to obtain a toner particle dispersion (T-14).

A total of 0.12 part of the charge control agent-dispersed solution (CD-1a) and 89.88 parts of MORESCO WHITE MT-30T were mixed with 10 parts of the toner particle dispersion (T-14) to obtain a liquid developer (LD-14).

TABLE 3

| Liquid developer | Polyester resin | Polymer | charging auxiliary agent | Carrier liquid | Acid value (mg KOH/g) | Amine value (mg KOH/g) | pKa | Mn | Production method |
|---|---|---|---|---|---|---|---|---|---|
| LD-1 | PES-1 | Dis-1 | — | MT-30P | 14 | 70 | 3.2 | 3,700 | A |
| LD-2 | PES-2 | Dis-1 | — | MT-30P | 14 | 70 | 3.2 | 4,900 | A |
| LD-3 | PES-3 | Dis-1 | — | MT-30P | 10 | 70 | 3.2 | 10,000 | A |
| LD-4 | PES-4 | Dis-1 | — | MT-30P | 14 | 70 | 3.2 | 2,900 | A |
| LD-5 | PES-5 | Dis-1 | — | MT-30P | 14 | 70 | 3.2 | 4,000 | A |
| LD-6 | PES-6 | Dis-1 | — | MT-30P | 14 | 70 | 3.2 | 2,600 | A |
| LD-7 | PES-7 | Dis-1 | — | MT-30P | 14 | 70 | 2.5 | 3,800 | A |
| LD-8 | PES-8 | Dis-1 | — | MT-30P | 14 | 70 | 3.1 | 3,800 | A |
| LD-9 | PES-9 | Dis-1 | — | MT-30P | 14 | 70 | 2.8 | 3,800 | A |
| LD-10 | PES-2 | Dis-2 | — | MT-30P | 14 | 35 | 3.2 | 4,900 | A |
| LD-11 | PES-2 | Dis-3 | — | MT-30P | 14 | 39 | 3.2 | 4,900 | A |
| LD-12 | PES-2 | Dis-4 | — | MT-30P | 14 | 20 | 3.2 | 4,900 | A |
| LD-13 | PES-2 | Dis-5 | — | MT-30P | 14 | 70 | 3.2 | 4,900 | A |
| LD-14 | PES-2 | Dis-1 | E-84 | MT-30P | 14 | 70 | 3.2 | 4,900 | A |

In the table, MT-30P represents MORESCO WHITE MT-30P (SP value: 7.90, volume resistivity: $8.4\times10^{12}$ Ω·cm);

E-84 represents BONTRON E-84 (manufactured by Orient Chemical Industries Co., Ltd.); and "A" in the manufacturing method represents a wet pulverization method.

<Production Examples of Liquid Developers (LD-15) to (LD-28)>

Liquid developers (LD-15) to (LD-28) were obtained in the same manner as in the production example of the liquid developer (LD-1) or (LD-14), except that the types of the polyester resin, polymer having a primary amino group, and carrier liquid were changed to those shown in Table 4, the charge control agent-dispersion solution (CD-1a) was changed to the charge control agent-dispersed solution (CD-1b), and also 0.021 part of (Exemplary Compound B-26) as a photopolymerization initiator and 0.035 part of KAYACURE-DETXS (2,4-diethylthioxanthone, manufactured by Nippon Kayaku Co., Ltd.) as a sensitizer were added.

TABLE 4

| Liquid developer | Polyester resin | Polymer | charging auxiliary agent | Carrier liquid | Acid value (mg KOH/g) | Amine value (mg KOH/g) | pKa | Mn | Production method |
|---|---|---|---|---|---|---|---|---|---|
| LD-15 | PES-1 | Dis-1 | — | DDVE | 14 | 70 | 3.2 | 3,700 | A |
| LD-16 | PES-2 | Dis-1 | — | DDVE | 14 | 70 | 3.2 | 4,900 | A |
| LD-17 | PES-3 | Dis-1 | — | DDVE | 10 | 70 | 3.2 | 10,000 | A |
| LD-18 | PES-4 | Dis-1 | — | DDVE | 14 | 70 | 3.2 | 2,900 | A |
| LD-19 | PES-5 | Dis-1 | — | DDVE | 14 | 70 | 3.2 | 4,000 | A |
| LD-20 | PES-6 | Dis-1 | — | DDVE | 14 | 70 | 3.2 | 2,600 | A |
| LD-21 | PES-7 | Dis-1 | — | DDVE | 14 | 70 | 2.5 | 3,800 | A |
| LD-22 | PES-8 | Dis-1 | — | DDVE | 14 | 70 | 3.1 | 3,800 | A |
| LD-23 | PES-9 | Dis-1 | — | DDVE | 14 | 70 | 2.8 | 3,800 | A |
| LD-24 | PES-2 | Dis-2 | — | DDVE | 14 | 35 | 3.2 | 4,900 | A |
| LD-25 | PES-2 | Dis-3 | — | DDVE | 14 | 39 | 3.2 | 4,900 | A |
| LD-26 | PES-2 | Dis-4 | — | DDVE | 14 | 20 | 3.2 | 4,900 | A |
| LD-27 | PES-2 | Dis-5 | — | DDVE | 14 | 70 | 3.2 | 4,900 | A |
| LD-28 | PES-2 | Dis-1 | E-84 | DDVE | 14 | 70 | 3.2 | 4,900 | A |

In the table,

DDVE represents dodecyl vinyl ether (SP value: 8.13, volume resistivity: $3.1\times10^{12}$ Ω·cm).

<Production Examples of Comparative Liquid Developers (LD-101) to (LD-104)>

Liquid developers (LD-101) to (LD-104) were obtained in the same manner as in the production example of the liquid developer (LD-1), except that the types of the polyester resin, polymer having a primary amino group, and carrier liquid were changed to those shown in Table 5.

TABLE 5

| Comparative liquid developer | Polyester resin | Polymer | Carrier liquid | Acid value (mg KOH/g) | Amine value (mg KOH/g) | pKa | Mn | Production method |
|---|---|---|---|---|---|---|---|---|
| LD-101 | PES-101 | Dis-4 | MT-30P | 14 | 20 | 3.8 | 3,700 | A |
| LD-102 | PES-2 | Sol. | MT-30P | 14 | 200 | 3.2 | 4,900 | A |
| LD-103 | FC1565 | Dis-4 | MT-30P | 6 | 20 | 3.8 | 3,400 | A |
| LD-104 | PES-102 | Dis-4 | MT-30P | 2 | 20 | 3.2 | 4,000 | A |

In the table,

FC1565 is DIACRON FC-1565 (polyester resin, acid value 6 mg KOH/g, manufactured by Mitsubishi Chemical Corp.), trimellitic acid is contained in the molecular chain, and the end is mainly terephthalic acid.

Sol. represents Solsperse 13940 (manufactured by Japan Lubrizol Corp.) which is a polyester-based polymer having mainly a secondary or tertiary amino group (a primary amino group is not present at a position other than the end of the main chain of the polymer).

<Production Examples of Comparative Liquid Developers (LD-105) to (LD-108)>

Liquid developers (LD-105) to (LD-108) were obtained in the same manner as in the production example of the liquid developer (LD-15), except that the types of the polyester resin, polymer having a primary amino group, and carrier liquid were changed to those shown in Table 6.

TABLE 6

| Comparative liquid developer | Polyester resin | Polymer | Carrier liquid | Acid value (mg KOH/g) | Amine value (mg KOH/g) | pKa | Mn | Production method |
|---|---|---|---|---|---|---|---|---|
| LD-105 | PES-101 | Dis-4 | DDVE | 14 | 20 | 3.8 | 3,700 | A |
| LD-106 | PES-2 | Sol. | DDVE | 14 | 200 | 3.2 | 4,900 | A |
| LD-107 | FC1565 | Dis-4 | DDVE | 6 | 20 | 3.8 | 3,400 | A |
| LD-108 | PES-102 | Dis-4 | DDVE | 2 | 20 | 3.2 | 4,000 | A |

[Production Example of Liquid Developer by Coacervation Method]

<Production Example of Liquid Developer (LD-29)>

(Step of Preparing Resin-Dispersed Solution)

A total of 30 parts of Pigment Blue 15:3, 47 parts of VYLON UR4800 (manufactured by Toyobo Corp.), 255 parts of tetrahydrofuran, and 130 parts of glass beads (diameter 1 mm) were mixed and dispersed for 3 h with an attritor (manufactured by Nippon Coke & Engineering Co., Ltd.). Then, mesh filtration was performed to remove the glass beads and obtain a dispersion.

A total of 180 parts of the obtained dispersion, 126 parts of a tetrahydrofuran solution of the polyester resin (PES-1) (amount of solid fraction: 50% by mass), and 2.7 parts of the polymer (Dis-1) were mixed while stirring at 40° C. by using a high-speed dispersing apparatus (manufactured by PRIMIX Corp., T. K. Robomix/T. K. Homodisper 2.5-type blade) to obtain a resin-dispersed solution.

(Mixing Step)

A total of 70 parts of MORESCO WHITE MT-30P (manufactured by MORESCO Corporation, SP value: 7.90), which is a carrier liquid, was gradually added to 100 parts of the resin-dispersed solution by using a homogenizer (manufactured by IKA Corp., ULTRA-TURRAX T50) while stirring at a revolution speed of 25,000 rpm to prepare a mixed liquid.

(Distillation Step)

The obtained mixed liquid was transferred to a pear-shaped flask, and tetrahydrofuran was completely distilled off at 50° C. while ultrasonically dispersing the liquid to obtain a toner particle dispersion.

(Step of Preparing Liquid Developer)

A total of 0.12 part of the charge control agent-dispersed solution (CD-1a) and 89.88 parts of MORESCO WHITE MT-30T were mixed with 10 parts of the toner particle dispersion to obtain a liquid developer (LD-29).

<Production Examples of Liquid Developers (LD-30) to (LD-41)>

Liquid developers (LD-30) to (LD-41) were obtained in the same manner as in the production example of the liquid developer (LD-29), except that the types of the polyester resin, polymer having a primary amino group, and carrier liquid were changed to those shown in Table 7.

<Production Example of Liquid Developer (LD-42)>

(Step of Preparing Resin-Dispersed Solution)

A total of 30 parts of Pigment Blue 15:3, 47 parts of VYLON UR4800 (manufactured by Toyobo Corp.), 255 parts of tetrahydrofuran, and 130 parts of glass beads (diameter 1 mm) were mixed and dispersed for 3 h with an attritor (manufactured by Nippon Coke & Engineering Co., Ltd.). Then, mesh filtration was performed to remove the glass beads and obtain a dispersion.

A total of 180 parts of the obtained dispersion, 126 parts of a tetrahydrofuran solution of the polyester resin (PES-2) (amount of solid fraction: 50% by mass), 2.7 parts of the polymer (Dis-1), and 0.9 part of BONTRON E-84 were mixed while stirring at 40° C. by using a high-speed dispersing apparatus (manufactured by PRIMIX Corp., T. K. Robomix/T. K. Homodisper 2.5-type blade) to obtain a resin-dispersed solution.

(Mixing Step)

A total of 70 parts of MORESCO WHITE MT-30P (manufactured by MORESCO Corporation, SP value: 7.90), which is a carrier liquid, was gradually added to 100 parts of the resin-dispersed solution by using a homogenizer (manufactured by IKA Corp., ULTRA-TURRAX T50) while stirring at a revolution speed of 25,000 rpm to prepare a mixed liquid.

(Distillation Step)

The obtained mixed liquid was transferred to a pear-shaped flask, and tetrahydrofuran was completely distilled off at 50° C. while ultrasonically dispersing the liquid to obtain a toner particle dispersion.

(Step of Preparing Liquid Developer)

A total of 0.12 part of the charge control agent-dispersed solution (CD-1a) and 89.88 parts of MORESCO WHITE MT-30T were mixed with 10 parts of the toner particle dispersion to obtain a liquid developer (LD-42).

TABLE 7

| Liquid developer | Polyester resin | Polymer | charging auxiliary agent | Carrier liquid | Acid value (mg KOH/g) | Amine value (mg KOH/g) | pKa | Mn | Production method |
|---|---|---|---|---|---|---|---|---|---|
| LD-29 | PES-1 | Dis-1 | — | MT-30P | 14 | 70 | 3.2 | 3,700 | B |
| LD-30 | PES-2 | Dis-1 | — | MT-30P | 14 | 70 | 3.2 | 4,900 | B |
| LD-31 | PES-3 | Dis-1 | — | MT-30P | 10 | 70 | 3.2 | 10,000 | B |
| LD-32 | PES-4 | Dis-1 | — | MT-30P | 14 | 70 | 3.2 | 2,900 | B |
| LD-33 | PES-5 | Dis-1 | — | MT-30P | 14 | 70 | 3.2 | 4,000 | B |
| LD-34 | PES-6 | Dis-1 | — | MT-30P | 14 | 70 | 3.2 | 2,600 | B |
| LD-35 | PES-7 | Dis-1 | — | MT-30P | 14 | 70 | 2.5 | 3,800 | B |
| LD-36 | PES-8 | Dis-1 | — | MT-30P | 14 | 70 | 3.1 | 3,800 | B |
| LD-37 | PES-9 | Dis-1 | — | MT-30P | 14 | 70 | 2.8 | 3,800 | B |
| LD-38 | PES-2 | Dis-2 | — | MT-30P | 14 | 35 | 3.2 | 4,900 | B |
| LD-39 | PES-2 | Dis-3 | — | MT-30P | 14 | 39 | 3.2 | 4,900 | B |
| LD-40 | PES-2 | Dis-4 | — | MT-30P | 14 | 20 | 3.2 | 4,900 | B |
| LD-41 | PES-2 | Dis-5 | — | MT-30P | 14 | 70 | 3.2 | 4,900 | B |
| LD-42 | PES-2 | Dis-1 | E-84 | MT-30P | 14 | 70 | 3.2 | 4,900 | B |

In the table,

"B" in the manufacturing method represents a coacervation method.

<Production Examples of Liquid Developers (LD-43) to (LD-56)>

Liquid developers (LD-43) to (LD-56) were obtained in the same manner as in the production example of the liquid developer (LD-29) or (LD-42), except that the types of the polyester resin, polymer having a primary amino group, and carrier liquid were changed to those shown in Table 8, the charge control agent-dispersion solution (CD-1a) was changed to the charge control agent-dispersed solution (CD-1b), and also 0.021 part of (Exemplary Compound B-26) as a photopolymerization initiator and 0.035 part of KAYACURE-DETXS (2,4-diethylthioxanthone, manufactured by Nippon Kayaku Co., Ltd.) as a sensitizer were added.

TABLE 8

| Liquid developer | Polyester resin | Polymer | Charging auxiliary agent | Carrier liquid | Acid value (mg KOH/g) | Amine value (mg KOH/g) | pKa | Mn | Production method |
|---|---|---|---|---|---|---|---|---|---|
| LD-43 | PES-1 | Dis-1 | — | DDVE | 14 | 70 | 3.2 | 3,700 | B |
| LD-44 | PES-2 | Dis-1 | — | DDVE | 14 | 70 | 3.2 | 4,900 | B |
| LD-45 | PES-3 | Dis-1 | — | DDVE | 10 | 70 | 3.2 | 10,000 | B |
| LD-46 | PES-4 | Dis-1 | — | DDVE | 14 | 70 | 3.2 | 2,900 | B |
| LD-47 | PES-5 | Dis-1 | — | DDVE | 14 | 70 | 3.2 | 4,000 | B |
| LD-48 | PES-6 | Dis-1 | — | DDVE | 14 | 70 | 3.2 | 2,600 | B |
| LD-49 | PES-7 | Dis-1 | — | DDVE | 14 | 70 | 2.5 | 3,800 | B |
| LD-50 | PES-8 | Dis-1 | — | DDVE | 14 | 70 | 3.1 | 3,800 | B |
| LD-51 | PES-9 | Dis-1 | — | DDVE | 14 | 70 | 2.8 | 3,800 | B |
| LD-52 | PES-2 | Dis-2 | — | DDVE | 14 | 35 | 3.2 | 4,900 | B |
| LD-53 | PES-2 | Dis-3 | — | DDVE | 14 | 39 | 3.2 | 4,900 | B |
| LD-54 | PES-2 | Dis-4 | — | DDVE | 14 | 20 | 3.2 | 4,900 | B |
| LD-55 | PES-2 | Dis-5 | — | DDVE | 14 | 70 | 3.2 | 4,900 | B |
| LD-56 | PES-2 | Dis-1 | E-84 | DDVE | 14 | 70 | 3.2 | 4,900 | B |

<Production Examples of Comparative Liquid Developers (LD-109) to (LD-112)>

Comparative liquid developers (LD-109) to (LD-112) were obtained in the same manner as in the production example of the liquid developer (LD-29), except that the types of the polyester resin, polymer having a primary amino group, and carrier liquid were changed to those shown in Table 9.

TABLE 9

| Comparative liquid developer | Polyester resin | Polymer | Carrier liquid | Acid value (mg KOH/g) | Amine value (mg KOH/g) | pKa | Mn | Production method |
|---|---|---|---|---|---|---|---|---|
| LD-109 | PES-101 | Dis-4 | MT-30P | 14 | 20 | 3.8 | 3,700 | B |
| LD-110 | PES-2 | Sol. | MT-30P | 14 | 200 | 3.2 | 4,900 | B |
| LD-111 | FC1565 | Dis-4 | MT-30P | 6 | 20 | 3.8 | 3,400 | B |
| LD-112 | PES-102 | Dis-4 | MT-30P | 2 | 20 | 3.2 | 4,000 | B |

<Production Examples of Comparative Liquid Developers (LD-113) to (LD-116)>

Liquid developers (LD-113) to (LD-116) were obtained in the same manner as in the production example of the liquid developer (LD-43), except that the types of the polyester resin, polymer having a primary amino group, and carrier liquid were changed to those shown in Table 10.

TABLE 10

| Comparative liquid developer | Polyester resin | Polymer | Carrier liquid | Acid value (mg KOH/g) | Amine value (mg KOH/g) | pKa | Mn | Production method |
|---|---|---|---|---|---|---|---|---|
| LD-113 | PES-101 | Dis-4 | DDVE | 14 | 20 | 3.8 | 3,700 | B |
| LD-114 | PES-2 | Sol. | DDVE | 14 | 200 | 3.2 | 4,900 | B |
| LD-115 | FC1565 | Dis-4 | DDVE | 6 | 20 | 3.8 | 3,400 | B |
| LD-116 | PES-102 | Dis-4 | DDVE | 2 | 20 | 3.2 | 4,000 | B |

<Evaluation of Liquid Developers>

The liquid developers (LD-1) to (LD-56) (referred to hereinbelow as Examples) and (LD-101) to (LD-116) (referred to hereinbelow as Comparative Examples) were evaluated by the following methods.

<Evaluation of Volume Resistivity>

The volume resistivity of the liquid developers was measured by the above-described method.

The evaluation criteria are presented hereinbelow.

5: $1\times10^{10}$ Ω·cm≤(volume resistivity)

4: $1\times10^{9}$ Ω·cm≤(volume resistivity)<$1\times10^{10}$ Ω·cm

3: $5\times10^{8}$ Ω·cm≤(volume resistivity)<$1\times10^{9}$ Ω·cm

2: $1\times10^{8}$ Ω·cm≤(volume resistivity)<$5\times10^{8}$ Ω·cm

1: (volume resistivity)<$1\times10^{8}$ Ω·cm

The evaluation results are shown in Tables 11-1 and 11-2.

<Evaluation of Developing Performance>

Development was performed by the following methods by using the liquid developers. A developing apparatus 50C such as shown in the FIGURE was used.

(1) A developing roller 53C, a photosensitive drum 52C, and an intermediate transfer roller 61C were disassembled and rotationally driven in the directions shown in the FIGURE in a contactless state. The rotation speed at this time was 250 mm/sec.

(2) The developing roller 53C and the photosensitive drum 52C were brought into contact with each other under a constant pushing pressure, and a bias was set to 200 V by using a DC power source.

(3) The photosensitive drum 52C and the intermediate transfer roller 61C were brought into contact with each other under a constant pushing pressure, and a transfer bias was set to 1000 V by using a DC power source.

(4) A liquid developer of uniform concentration (toner particle concentration 2% by mass) and uniform amount (100 mL) was supplied to a film forming roller (not shown), and an image formed on an intermediate transfer member 60C was evaluated.

Criteria for evaluating the developing performance are shown hereinbelow.

5: a high-density and high-resolution image was obtained

4: a certain density unevenness was present or certain image blurring was observed 3: although density unevenness and image blurring were conspicuous, an image was developed 2: significant density unevenness and image blurring appeared and development was incomplete 1: development was no performed The evaluation results are shown in Tables 11-1 and 11-2.

TABLE 11-1

| Liquid developer | Volume resistivity | Developing performance |
|---|---|---|
| LD-1 | 5 | 5 |
| LD-2 | 5 | 5 |
| LD-3 | 5 | 5 |
| LD-4 | 4 | 4 |
| LD-5 | 5 | 5 |
| LD-6 | 4 | 4 |
| LD-7 | 4 | 4 |
| LD-8 | 4 | 4 |
| LD-9 | 4 | 4 |
| LD-10 | 4 | 4 |
| LD-11 | 4 | 4 |
| LD-12 | 4 | 4 |
| LD-13 | 4 | 4 |
| LD-14 | 5 | 5 |
| LD-15 | 5 | 5 |
| LD-16 | 5 | 5 |

TABLE 11-1-continued

| Liquid developer | Volume resistivity | Developing performance |
|---|---|---|
| LD-17 | 5 | 5 |
| LD-18 | 4 | 4 |
| LD-19 | 5 | 5 |
| LD-20 | 4 | 4 |
| LD-21 | 4 | 4 |
| LD-22 | 4 | 4 |
| LD-23 | 4 | 4 |
| LD-24 | 4 | 4 |
| LD-25 | 4 | 4 |
| LD-26 | 4 | 4 |
| LD-27 | 4 | 4 |
| LD-28 | 5 | 5 |
| LD-29 | 5 | 5 |
| LD-30 | 5 | 5 |
| LD-31 | 5 | 5 |
| LD-32 | 4 | 4 |
| LD-33 | 5 | 5 |
| LD-34 | 4 | 4 |
| LD-35 | 4 | 4 |
| LD-36 | 4 | 4 |
| LD-37 | 4 | 4 |
| LD-38 | 4 | 4 |
| LD-39 | 4 | 4 |
| LD-40 | 4 | 4 |
| LD-41 | 4 | 4 |
| LD-42 | 5 | 5 |
| LD-43 | 5 | 5 |
| LD-44 | 5 | 5 |
| LD-45 | 5 | 5 |
| LD-46 | 4 | 4 |
| LD-47 | 5 | 5 |
| LD-48 | 4 | 4 |
| LD-49 | 4 | 4 |
| LD-50 | 4 | 4 |
| LD-51 | 4 | 4 |
| LD-52 | 4 | 4 |
| LD-53 | 4 | 4 |
| LD-54 | 4 | 4 |
| LD-55 | 4 | 4 |
| LD-56 | 5 | 5 |

TABLE 11-2

| Comparative liquid developer | Volume resistivity | Developing performance |
|---|---|---|
| LD-101 | 1 | 1 |
| LD-102 | 2 | 1 |
| LD-103 | 3 | 2 |
| LD-104 | 1 | 1 |
| LD-105 | 2 | 1 |
| LD-106 | 2 | 1 |
| LD-107 | 3 | 2 |
| LD-108 | 1 | 1 |
| LD-109 | 2 | 1 |
| LD-110 | 2 | 1 |
| LD-111 | 3 | 2 |
| LD-112 | 1 | 1 |
| LD-113 | 2 | 1 |
| LD-114 | 2 | 1 |
| LD-115 | 3 | 2 |
| LD-116 | 1 | 1 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-188259, filed, Sep. 28, 2017, and Japanese Patent Application No. 2018-021287, filed, Feb. 8, 2018, which are hereby incorporated by reference herein in their entirety.

What is claimed is:

1. A liquid developer, comprising:

a carrier liquid;

a toner particle that is insoluble in the carrier liquid, the toner particle comprising a polyester resin having an acidic group, an acid value of the polyester resin being at least 5 mg KOH/g and a pKa of the acidic group being not more than 3.4; and a polymer that is soluble in the carrier liquid, wherein the polymer comprises a primary amino group at a position other than the end of a main chain of the polymer.

2. The liquid developer according to claim 1, wherein the pKa of the acidic group is not more than 3.2.

3. The liquid developer according to claim 1, wherein the acidic group is at least one member selected from the group consisting of a carboxyl group, a sulfone group and a phosphone group.

4. The liquid developer according to claim 2, wherein the acidic group is at least one member selected from the group consisting of a carboxyl group, a sulfone group and a phosphone group.

5. The liquid developer according to claim 1, wherein the polyester resin comprises a monomer unit derived from trimellitic acid or trimellitic anhydride, and the acidic group is a carboxyl group derived from trimellitic acid or trimellitic anhydride.

6. The liquid developer according to claim 1, wherein the polymer having a primary amino group is a polyallylamine derivative comprising in one polymer a monomer unit represented by Formula (4) and a monomer unit represented by Formula (6)

(4)

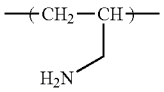

(6)

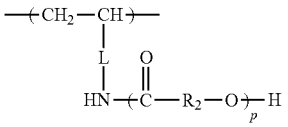

where $R_2$ is an optionally substituted alkylene group having at least 6 carbon atoms or an optionally substituted cycloalkylene group having at least 6 carbon atoms, p represents an integer of at least 1, and L represents a divalent linking group.

7. The liquid developer according to claim 6, wherein the polymer having a primary amino group is a reaction product of polyallylamine and a self-condensate of 12-hydroxystearic acid.

8. The liquid developer according to claim 1, wherein a number average molecular weight of the polyester resin is from 3000 to 15000.

9. A method of producing a liquid developer comprising a carrier liquid, a toner particle that is insoluble in the carrier liquid, and a polymer that is soluble in the carrier liquid, the polymer comprising a primary amino group at a position other than the end of a main chain of the polymer, the method comprising the steps of:

preparing a resin-dispersed solution comprising a polyester resin having an acidic group, said polymer having a primary amino group, and a solvent dissolving the polyester resin;

preparing a mixed liquid including the resin-dispersed solution and the carrier liquid; and distilling off the solvent from the mixed liquid, wherein an acid value of the polyester resin having an acidic group is at least 5 mg KOH/g, and a pKa of the acidic group is not more than 3.4.

10. A method of producing a liquid developer comprising a carrier liquid, a toner particle that is insoluble in the carrier liquid, and a polymer that is soluble in the carrier liquid, the polymer comprising a primary amino group at a position other than the end of a main chain of the polymer, the method comprising the steps of:

preparing a resin-dispersed solution comprising a polyester resin having an acidic group, a polymer having a primary amino group, and a solvent dissolving the polyester resin;

preparing a first mixed liquid comprising the resin-dispersed solution and a solvent that does not dissolve the polyester resin, the solvent being other than the carrier liquid;

preparing a toner particle dispersion by distilling off the solvent dissolving the polyester resin from the first mixed liquid; and preparing a second mixed liquid including the toner particle dispersion and the carrier liquid, wherein an acid value of the polyester resin having an acidic group is at least 5 mg KOH/g, and a pKa of the acidic group is not more than 3.4.

* * * * *